US008393049B2

(12) United States Patent
Vogel

(10) Patent No.: US 8,393,049 B2
(45) Date of Patent: Mar. 12, 2013

(54) SURFACE CLEANING AND RECYCLING APPARATUS AND METHOD

(75) Inventor: Hans E. Vogel, Palmer, AK (US)

(73) Assignee: Triverus, LLC, Palmer, AK (US)

( * ) Notice: Subject to any disclaimer, the term of this patent is extended or adjusted under 35 U.S.C. 154(b) by 406 days.

(21) Appl. No.: 12/775,279

(22) Filed: May 6, 2010

(65) Prior Publication Data

US 2010/0269860 A1 Oct. 28, 2010

Related U.S. Application Data

(63) Continuation-in-part of application No. 11/301,462, filed on Dec. 12, 2005, now Pat. No. 7,735,186.

(60) Provisional application No. 61/176,023, filed on May 6, 2009.

(51) Int. Cl.
*A47L 7/00* (2006.01)

(52) U.S. Cl. ..... 15/320; 15/322

(58) Field of Classification Search ..... 15/320, 15/322; 134/10, 45

See application file for complete search history.

(56) References Cited

U.S. PATENT DOCUMENTS

| | | | | | |
|---|---|---|---|---|---|
| 3,870,489 | A | | 3/1975 | Shaddock | |
| 4,325,901 | A | * | 4/1982 | Holding et al. | 264/146 |
| 4,586,208 | A | | 5/1986 | Trevarthen | |
| 4,696,075 | A | | 9/1987 | Grave | |
| 5,228,623 | A | * | 7/1993 | Raghavan et al. | 239/227 |
| 5,287,589 | A | | 2/1994 | Hughes | |
| 5,404,613 | A | | 4/1995 | Whyte | |
| 5,407,584 | A | | 4/1995 | Broussard | |
| 5,444,892 | A | | 8/1995 | Ris et al. | |
| 5,659,923 | A | * | 8/1997 | Coombs | 15/398 |
| 5,826,298 | A | * | 10/1998 | Rohrbacher et al. | 15/321 |
| 5,947,300 | A | | 9/1999 | Lange | |
| 5,970,574 | A | * | 10/1999 | Thrash, Jr. | 15/321 |
| 5,991,968 | A | * | 11/1999 | Moll et al. | 15/322 |
| 6,017,400 | A | * | 1/2000 | Clark et al. | 134/21 |
| 6,129,094 | A | * | 10/2000 | Moll et al. | 134/21 |
| 6,161,250 | A | | 12/2000 | Young et al. | |
| 6,206,980 | B1 | * | 3/2001 | Robinson | 134/21 |
| RE37,162 | E | * | 5/2001 | Roden | 15/321 |
| 6,302,967 | B1 | * | 10/2001 | Rohrbacher et al. | 134/10 |
| 6,370,728 | B1 | * | 4/2002 | Burns | 15/320 |
| 6,378,163 | B1 | * | 4/2002 | Moll et al. | 15/322 |
| 6,381,801 | B1 | | 5/2002 | Clemons | |
| 6,481,448 | B2 | | 11/2002 | Mathieu | |
| 6,536,067 | B1 | | 3/2003 | Truan et al. | |
| 6,675,437 | B1 | | 1/2004 | York | |
| 6,896,742 | B2 | | 5/2005 | Geyer et al. | |
| RE39,422 | E | | 12/2006 | Clemons | |
| 7,171,722 | B2 | * | 2/2007 | Keller | 15/322 |
| 7,290,307 | B1 | * | 11/2007 | Chao | 15/322 |
| 7,735,186 | B1 | * | 6/2010 | Vogel | 15/320 |
| 7,770,254 | B2 | * | 8/2010 | Alexander | 15/321 |
| 2002/0002985 | A1 | | 1/2002 | Mathieu | |
| 2002/0178529 | A1 | * | 12/2002 | Geyer et al. | 15/320 |
| 2003/0037805 | A1 | | 2/2003 | Mathieu | |
| 2005/0198752 | A1 | * | 9/2005 | McGraw | 15/1.7 |
| 2005/0210623 | A1 | | 9/2005 | Buckner | |
| 2010/0068042 | A1 | * | 3/2010 | Bruck et al. | 415/174.2 |

FOREIGN PATENT DOCUMENTS

| | | |
|---|---|---|
| KR | 10-0755581 | 9/2007 |
| WO | WO02/097197 | 12/2002 |

* cited by examiner

*Primary Examiner* — David B Thomas

(74) *Attorney, Agent, or Firm* — Deborah A. Peacock; Justin R. Jackson; Peacock Myers, P.C.

(57) ABSTRACT

A method and apparatus for cleaning large surface areas. The method and vehicle clean large surface areas such as streets, runways, aircraft carrier decks, and the like, wherein a substantial portion of the soiled water is recaptured, processed, and reused.

26 Claims, 26 Drawing Sheets

SURFACE CLEANING AND RECYCLING APPARATUS AND METHOD

CROSS-REFERENCE TO RELATED APPLICATIONS

This application is a continuation-in-part application of U.S. patent application Ser. No. 11/301,462, entitled "Surface Cleaning Vehicle", to Hans E. Vogel, filed on Dec. 12, 2005, and the specification and claims thereof are incorporated herein by reference.

This application also claims priority to and the benefit of the filing of U.S. Provisional Patent Application Ser. No. 61/176,023, entitled "Surface Cleaning Vehicle", filed on May 6, 2009, and the specification thereof is incorporated herein by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. N00014-02-M-0176 awarded by the U.S. Navy.

BACKGROUND OF THE INVENTION

1. Field of the Invention (Technical Field)

The present invention relates to a cleaning method and apparatus. Particularly, the present invention relates to a method and apparatus for cleaning a large surface area. No soaps or solvents are required, and a substantial portion of cleaning water is recovered for reuse. Embodiments of the present invention also relate to obstacle clearance and/or recovery systems.

2. Description of Related Art

Note that the following discussion refers to a publication that due to recent publication date is possibly not to be considered as prior art vis-a-vis the present invention. Discussion of such publication herein is given for more complete background and is not to be construed as an admission that such publication is prior art for patentability determination purposes.

Since the U.S. Navy first introduced the aircraft carrier, keeping the large deck area clean has proven challenging and costly. This is particularly true since the various aircraft which use the deck often leak oils, greases, and other fluids onto the deck. This impairs the ability of aircraft to gain proper traction which results in pilots struggling to maintain full control of their aircraft. In response, the Navy has expended vast sums of money and manpower to manually apply soap and water to the deck and then scrub the entire surface with brushes. Since the surface area of the decks of aircraft carriers are very large, substantial amounts of soap are required to clean them. The cost of soap for one aircraft carrier alone can amount to nearly $70,000 per deployment. Further, manually soaping and scrubbing the entire deck of an aircraft carrier impedes the use of the deck by aircraft during the extensive cleaning process, thus resulting in down time for the ship.

While various vehicles are known to be of use for cleaning surfaces, none of the known systems enable a user to continuously recycle virtually all the water used by using solid-liquid and liquid-liquid cyclones as well as strainers and/or a self-flushing filter. U.S. Pat. No. 6,381,801, to Clemons, Sr. describes one such system. The disclosure of that patent, however, is directed to a very large vehicle which relies primarily on filters to achieve water recycling. Those skilled in the art readily recognize that the Clemons, Sr. design is highly susceptible to filter clogging. A system which relies primarily on filters for the purpose of continuous water recycling has the serious drawback of repeatedly requiring a user to remove and clean filters after operation of the vehicle for only short periods of time. As such, the vehicle of Clemons, Sr. not only is inefficient and maintenance prone, but is also a very large and bulky vehicle.

Other cleaning vehicles known in the art are typically very large and must carry two water tanks onboard to sustain operation. A first tank is generally a clean water tank and a second is typically a recovery tank. An embodiment of the present invention eliminates the use of a clean water tank and uses an air-water recovery system.

None of the known prior art vehicles provide a soapless/brushless solution for cleaning large surface areas. Because embodiments of the present invention can recycle the water that is used, discharge regulations which exist for certain areas are more easily complied with. Other embodiments of the invention utilize a brush-membrane system.

There is thus a present need for a mobile cleaning, reclamation, and recycling apparatus that enables a user to recycle virtually all of the water used through the efficient use of cyclones within a compact and mobile unit.

BRIEF SUMMARY OF THE INVENTION

One embodiment of the present invention comprises a mobile cleaning apparatus for cleaning large surface areas. The apparatus preferably comprises one or more wheels, a cleaning head, a vacuum system, and a water processing unit. The water processing unit preferably comprises an air-water separator, a first tank, at least one solid-liquid cyclone, and a filter. The water processing unit can also optionally comprise one or more of the following: an inlet strainer, at least two solid-liquid cyclones and preferably three solid-liquid cyclones, a liquid-liquid cyclone, a decant tank, a float based inlet disposed on the first tank, an evacuating pump disposed downstream of the air-water separator, and a settling tank. The mobile cleaning apparatus of this embodiment can also optionally include a blower, a bulk recovery device, a skimmer, a liquid level sensor, and a pressure gauge.

A cleaning head of an embodiment of the present invention preferably comprises a deck, a nozzle disposed beneath said deck, a brush skirt, an inlet hole, and at least one air/water inlet. The cleaning head can optionally comprise one or more of the following: a separating membrane, a plurality of brushes making up the brush skirt, at least one swivel, at least one flow equalizer port, a vacuum recovery chamber, and a vacuum nozzle for the vacuum recovery chamber. The brush skirt preferably at least partially surrounds the circumference of the deck. The brush skirt also preferably comprises a membrane insert. The cleaning head of this embodiment is preferably capable of obstacle clearance.

Another embodiment of the present invention comprises a method for recycling water used for cleaning large surface areas. The method preferably comprises separating air from liquid constituents and solid constituents collected from cleaning via an air-water separator, separating the solid constituents from the liquid constituents via a solid-liquid cyclone, collecting the liquid constituents in a tank, and filtering the liquid constituents. This method can also optionally comprise one or more of the following: collecting solid constituents in a settling tank, controlling the liquid level control in the air-water separator, maintaining a vacuum separation of the air-water separator, modulating a pump based on the liquid constituent height in the air-water separator, using the filtered liquid constituents for cleaning a large surface area, storing the filter liquid constituents, collecting the solid constituents in a settling tank, passing the liquid constituents through a liquid-liquid cyclone, collecting the liquid constituents from the liquid-liquid cyclone in a decant tank, and straining the solid constituents and liquid constituents after the air-water cyclone.

An advantage of the present invention is that large surfaces are cleaned quickly and efficiently. Embodiments of the present invention relate to cleaning large surface areas by recycling a cleaning fluid such as water. Embodiments of the present invention also relate to obstacle clearing, and solids and liquids recovery.

Cyclone separation provides embodiments of the present invention to run for extended periods of time independent of a volume throughput limitation. Most filters have a limit on the amount of solids or oil that can pass. The onboard recovery/clean water tank design can also improve the space-saving aspects of the invention.

Embodiments of the solid-liquid cyclone can have a plurality of solid-liquid cyclones and an output of one solid-liquid cyclone can be connected in series or in parallel with one or more solid-liquid cyclones. Thus, an output of a one solid-liquid cyclone can be connected to an input of another solid-liquid cyclone in a series configuration or the plurality of solid-liquid cyclones can be connected in a manifold type configuration such that they are in parallel with one another.

If one or more solid-liquid cyclones are used in conjunction with one or more liquid-liquid cyclones, the one or more solid-liquid cyclones can be connected in series with one or more liquid-liquid cyclones. Optionally, one or more solid-liquid cyclones can be connected in parallel with one or more liquid-liquid cyclones.

Embodiments of the present invention relate to methods for cleaning large surface areas. The method includes but is not limited to generating a pressurized flow of water, emitting a spray of pressurized water from one or more rotatably attached nozzles, creating a flow of air around an area of the surface to be cleaned such that at least a substantial amount of the soiled water resulting from the cleaning process is recovered, passing the soiled water through a solid-liquid cyclone, capturing the liquid constituents of the soiled water from the solid-liquid cyclone, and recycling the liquid constituents of the soiled water such that they are again pressurized for re-use in the cleaning process.

The method can include, separately or in combination the following steps: passing the soiled water through a liquid-liquid cyclone, passing the liquid constituents of the solid-liquid cyclone through a liquid-liquid cyclone, passing the liquid constituents of the soiled water through a filter, and/or passing the liquid constituents of the soiled water through a self-flushing filter.

An object of the present invention is to provide a method and apparatus for cleaning one or more surfaces.

Other objects, advantages and novel features, and further scope of applicability of the present invention will be set forth in part in the detailed description to follow, taken in conjunction with the accompanying drawings, and in part will become apparent to those skilled in the art upon examination of the following, or can be learned by practice of the invention. The objects and advantages of the invention can be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
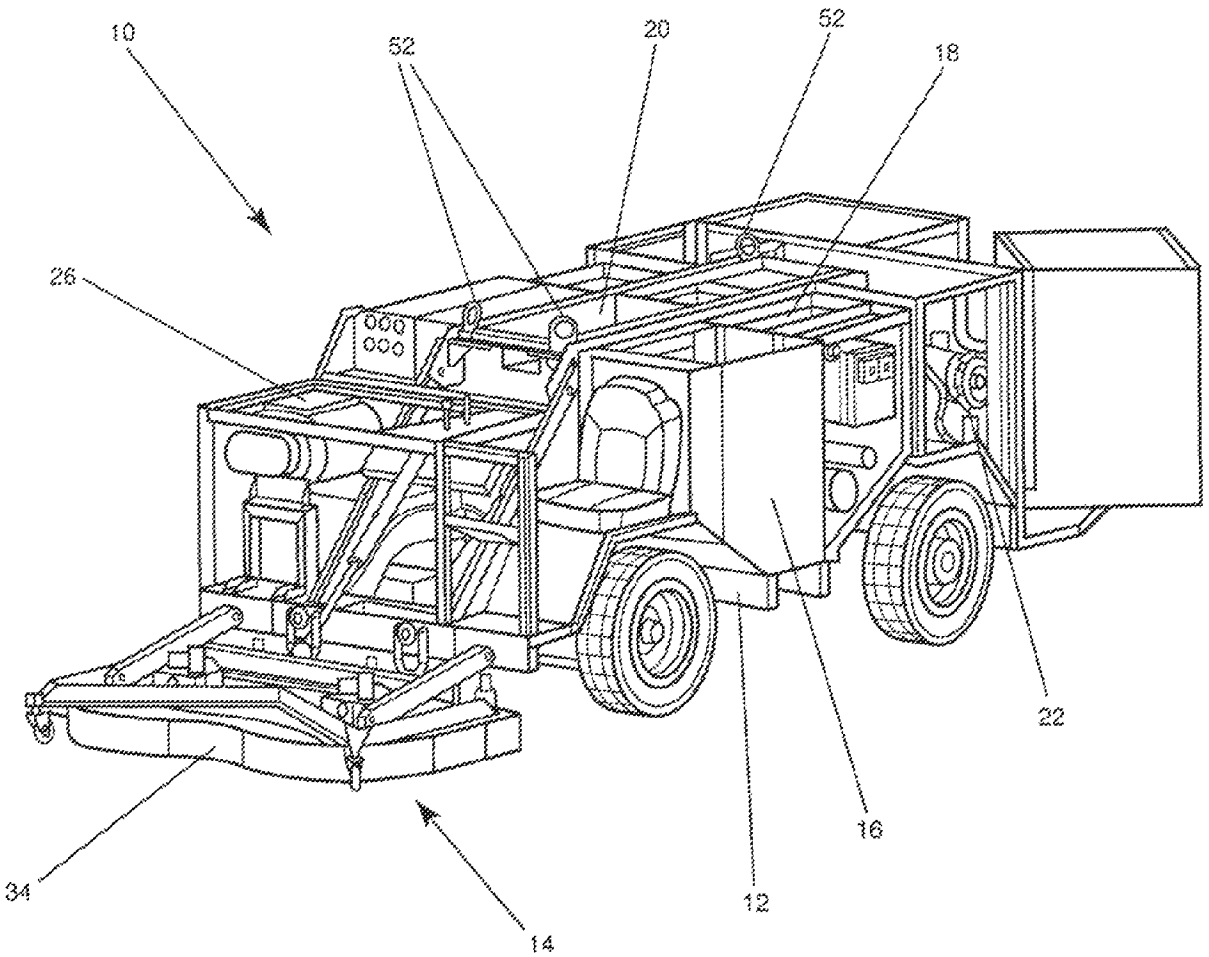
FIG. 1 illustrates a perspective view of the preferred embodiment of the present invention with the cleaning deck in the down position.
Figure 2A:
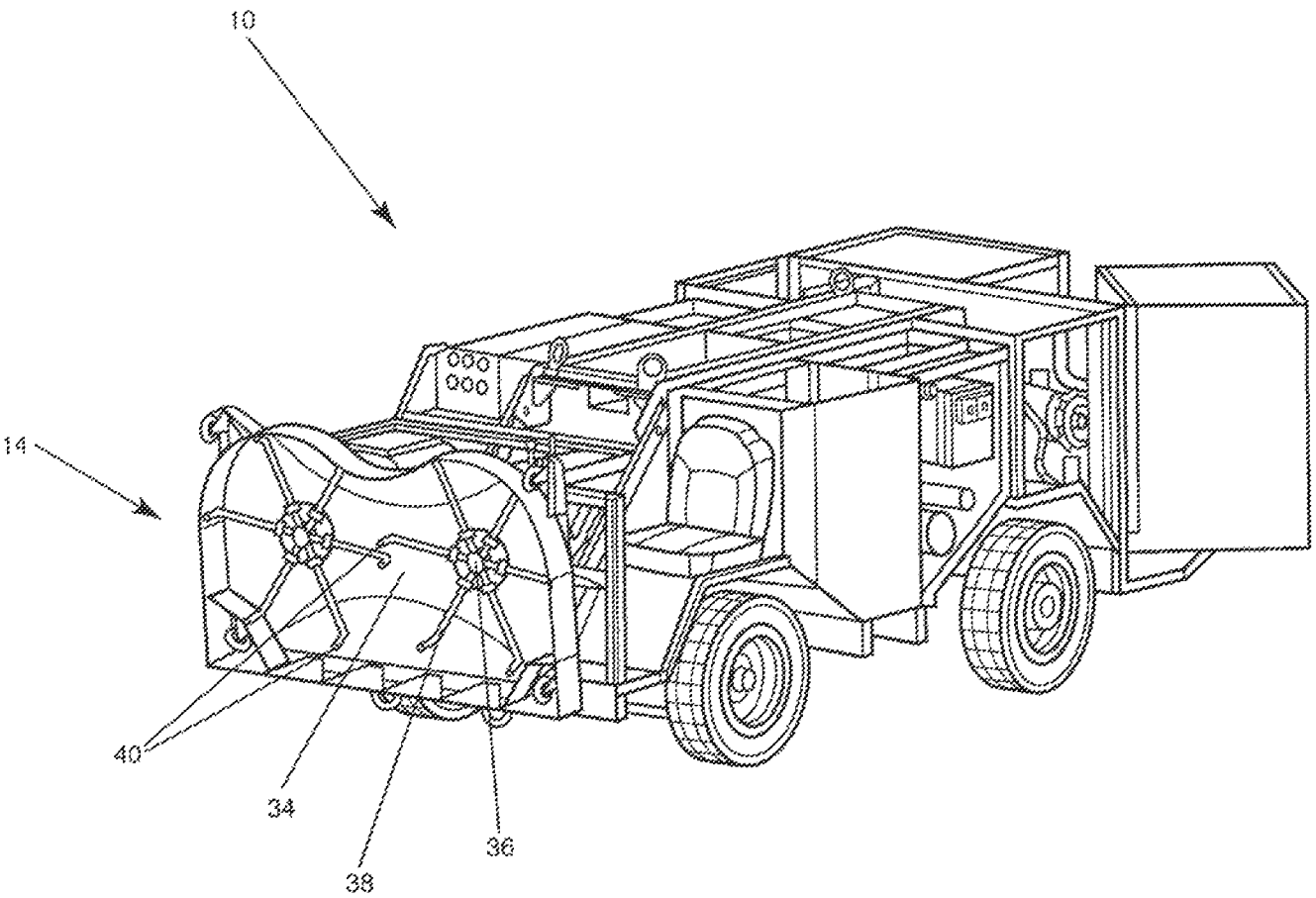
FIGS. 2A, 2B, 3A and 3B illustrate perspective views of a preferred embodiment of the vehicle of the present invention with the cleaning deck in the up position.
Figure 2B:
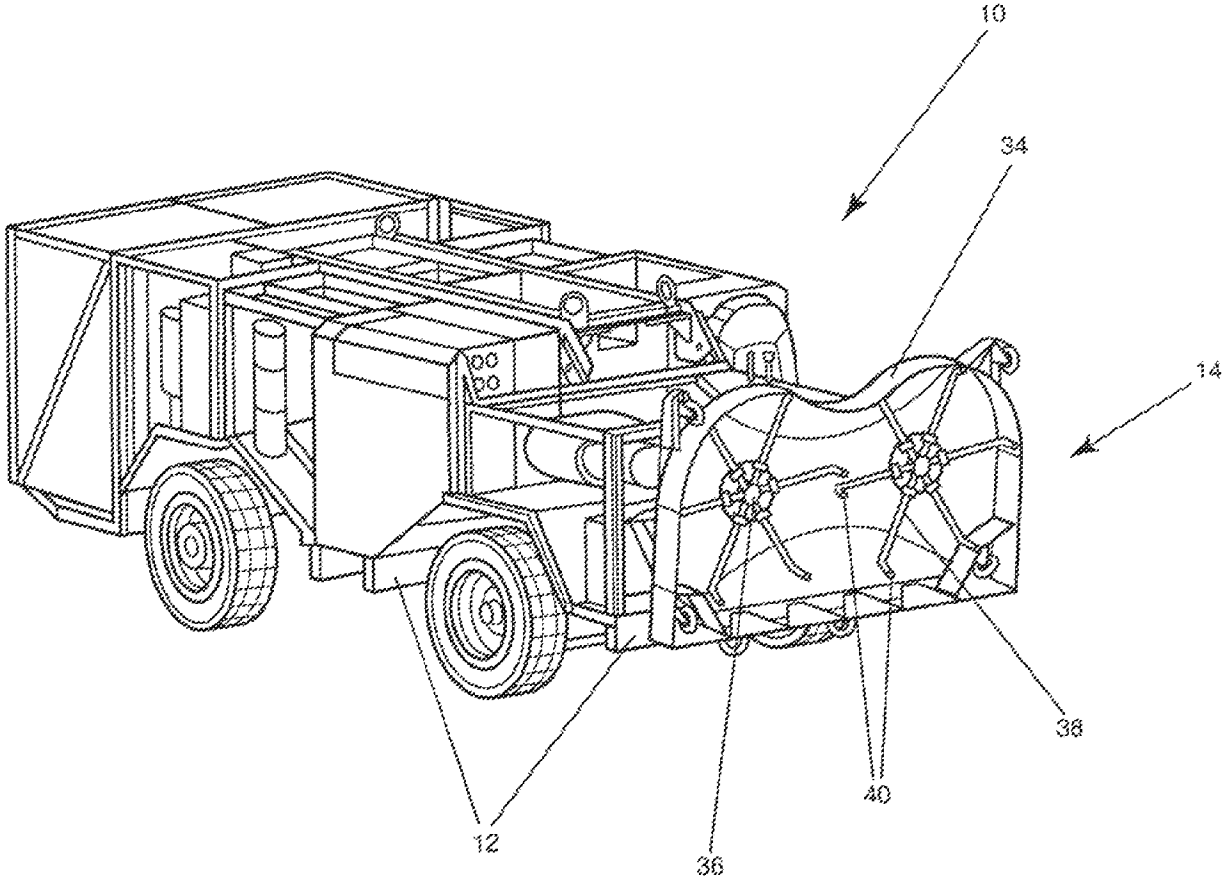
Figure 3A:
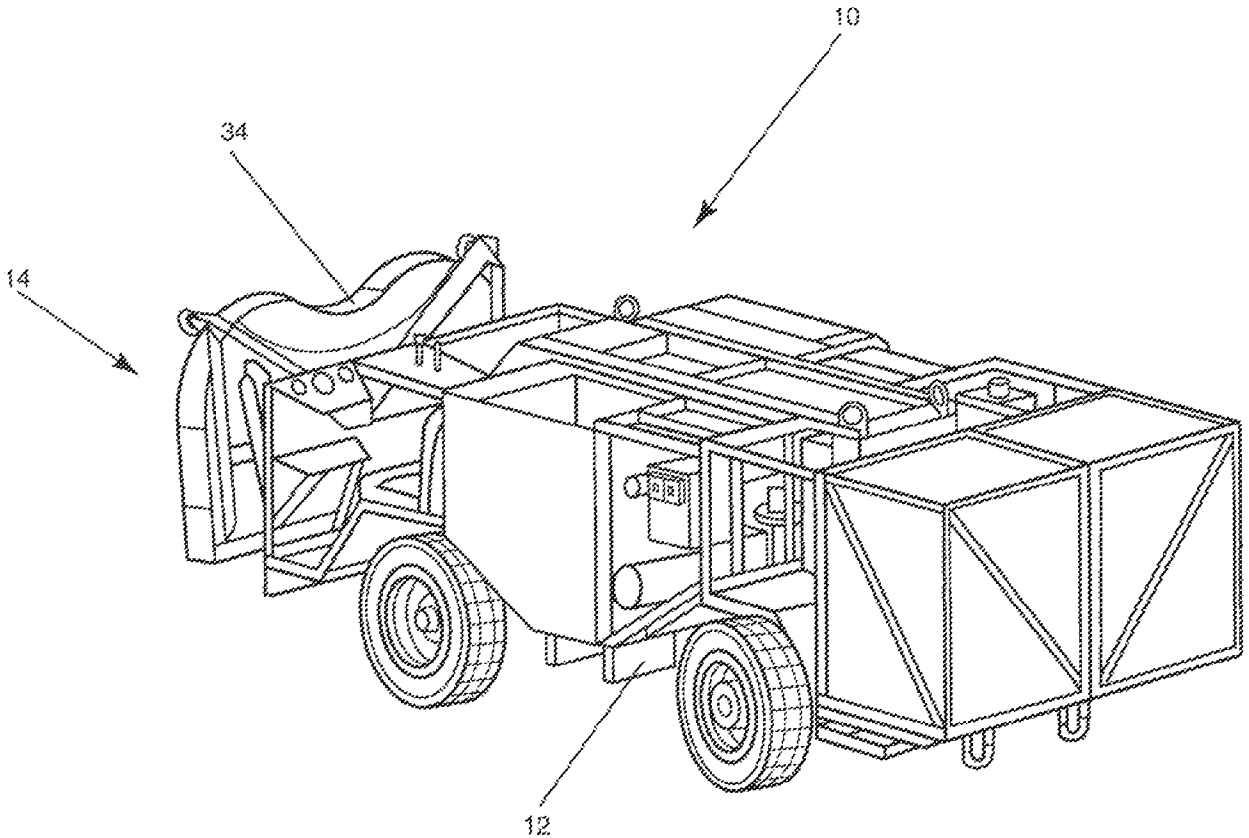
Figure 3B:
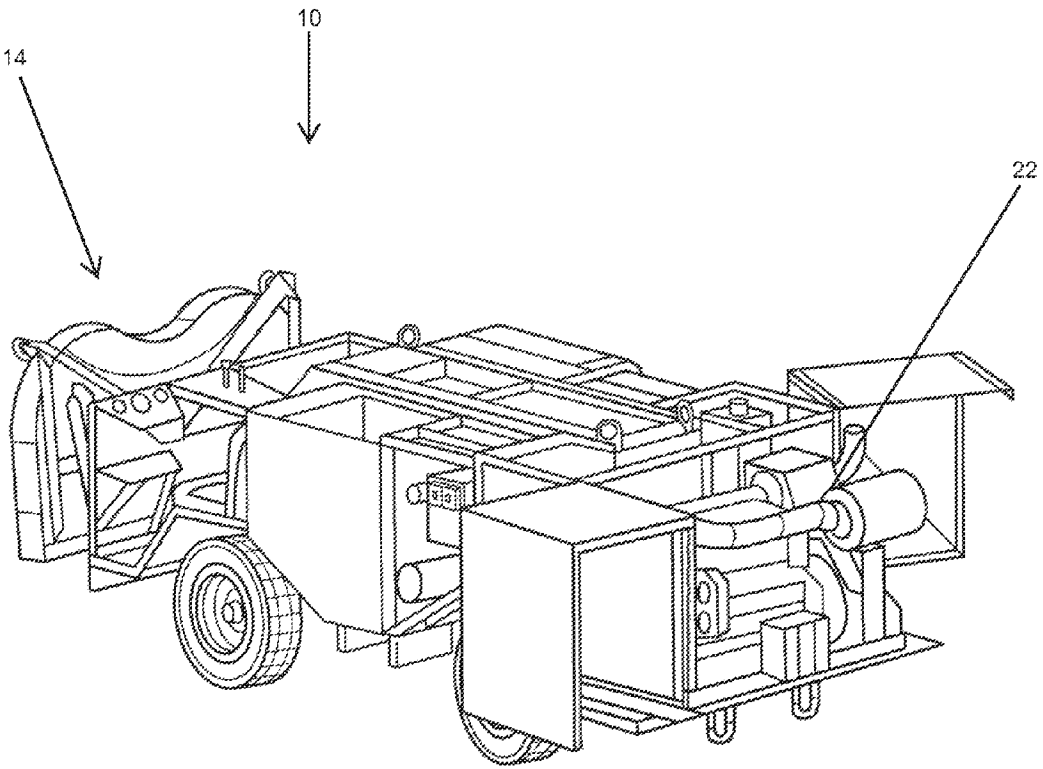

Embodiments of the present invention are directed to methods and apparatuses for rapidly cleaning large surface areas. Particularly, the present invention can be directed to methods and apparatuses for cleaning runways of aircraft carriers with a mobile cleaning vehicle wherein high-pressure water is sprayed onto the surface before being vacuumed up, processed, and reused. Optionally, the present invention can be used to remove dirt, oil, particulates, and rubber buildup from any surface which is driven on. Particularly desirable results can be obtained by using the present invention on runways, including both land-based runways and aircraft carrier runways.

The term "liquid-liquid cyclone" is used interchangeably throughout the specification and claims with the term "liquid-liquid separator". The term "solid-liquid cyclone" is used interchangeably throughout the specification and claims with the term "solid-liquid separator". The term "air-water cyclone" is used interchangeably throughout the specification and claims with the term "air-water separator". The term "brush" as used throughout the specification and claims includes but is not limited to any implement with protruding bristles, or any protrusion allowing for a wiping or brushing motion.

Although the vehicle illustrated in the figures has four wheels, other vehicles capable of transporting the various elements of the present invention can also produce desirable results. The term "wheel" and "wheels" as used through the specification and claims is intended to include any apparatus, device, structure, element, as well as combinations or multiples thereof which can be used to enable a vehicle to travel across a surface, including but not limited to wheels, tracks, treads, rails, etc. Further, although the present invention is primarily directed to cleaning surfaces of aircraft carriers, desirable results can be obtained when the present invention is used on a roadway, parking lot, runway, or other similar structure.

Embodiments of the present invention relate generally to a flat-surface cleaning vehicle which uses high pressure water for cleaning while an onboard cyclone-based system processes reclaimed water and returns it to cleaning service. The union of the cleaning/recovery operations with recycle capability allows the vehicle size to remain small since little water is needed to clean a large area. Although the vehicle can be physically small, the performance (square ft/hr) of the vehicle compares favorably with a much larger vehicle which does not include a recycling feature. The cyclone-based water recycle system of the present invention preferably enables it to recycle recovered wastewater fast enough to permit continuous cleaning with water recycled therewith. The hydrocyclone units are preferably capable of removing solids and oils from the recovered wastewater and returning clean water to the cleaning circuit for re-use. Embodiments of the present invention optionally have cleaning vehicles without a clean water tank compartment.

The recycle unit preferably processes wastewater using two varieties of cyclones. A liquid-liquid (L-L or LL) cyclone removes oil constituents from the wastewater. The L-L circuit preferably ensures removal of oils and greases from the water. The second type of hydrocyclone used is preferably a solid-liquid (S-L or SL) cyclone. This unit preferably removes solid constituents from the wastewater.

One advantage of the present invention is that contaminants recovered during cleaning are contained onboard for appropriate and easy disposal.

Embodiments of the present invention relate to a system and method for cleaning horizontal surfaces that are contaminated with any combination of oils, greases, particulates, and various other material buildups. As such the present invention can be used to remove rubber buildups from runways. Since embodiments of the present invention preferably separate what is sucked into the cleaning system into its constituent components, and since the processed water is reused, embodiments of the present invention can preferably operate for extended periods of time on a single tank of washing water and have the ability to store various contaminants which are recovered from the recycled water.

FIGS. 1-3B illustrate embodiments of the present invention which preferably include a mobile cleaning, reclamation, and recycling vehicle 10. Vehicle 10 preferably comprises vehicle chassis 12 that incorporates cleaning head 14 which is preferably disposed in front of or behind vehicle 10. Vehicle 10 also preferably has a vacuum recovery system, effluent containment system 16 ("recovery tank") and cyclone-based recycling system 18, which preferably returns processed water to clean water holding tank 20 for re-use. Referring to the figures generally, vehicle 10 is preferably powered by at least one primary power plant 22 which is used for propulsion. Although primary power plant 22 can be used for all power needs on vehicle 10, it is sometimes preferable that secondary and tertiary power plants be provided. If secondary and tertiary power plants are provided, it is preferable that they be used to power high-pressure cleaning pump 24 (which preferably generates a pressure of between approximately 1500 to approximately 6000 pounds per square inch of pressure and preferably approximately 5,000 pounds per square inch top pressure vacuum blower 26), large solid strainer 42, pump 28, solid-liquid cyclone pump 30, and/or liquid-liquid cyclone pump 32. While power can be distributed from the one or more power plants in a manner known to those skilled in the art, it is preferable that power be distributed mechanically, electrically, and/or hydraulically. Flow also plays an important role in distributing cleaning power to the surface. With an adequately proportioned recycle system, flow can be meaningful in the power calculation because higher flow nozzles are more robust and it is easier to distribute cleaning power over a larger area with greater flow resources.

A system that is flow restricted (i.e. a recycle system cannot keep up) must find other means of achieving cleaning horsepower either by chemical means, hot water or higher pressure. Either way, a flow restricted system increases vehicle complexity. The cyclones of the embodiments of the present invention enable use of a 5-micron filter where competing systems must use 30-microns as final filtration because of operating duration problems related to filter clogging.

FIGS. 2A, 2B, 3A, and 3B illustrate an apparatus of the present invention comprising cleaning head 14 in a raised position. Cleaning head 14 preferably comprises deck 34, beneath which a plurality of rotary members 36 are disposed. Rotary members 36 preferably comprise a plurality of wands 38 with spray nozzles 40 disposed at terminal portions thereof. When embodiments of the present invention are in operation, wands 38 with nozzles 40 preferably rotate above the surface to be cleaned. Accordingly, nozzles 40 rotate with respect to the surface to be cleaned.

In one embodiment, a user fills clean water holding tank 20 prior to use. Vehicle 10 is driven across a surface to be cleaned. Water is pumped from holding tank 20 through high-pressure pump 24 before passing through rotary members 36 and wands 38, whereupon the water is emitted by nozzles 40. Although high-pressure pump 24 is preferably a single large, high volume, high-pressure pump, a plurality of lower volume pumps can be used and will produce desirable results. Vacuum blower 26 preferably vacuums or sucks air, water, and small solid particulates through deck 34. The air, water, and debris sucked into vehicle 10 by blower 26 is preferably passed through strainer assembly 42, where the large solids can be removed. Similar to high-pressure pump 24, blower 26 is preferably a single large high volume blower. Alternatively, desirable results can also be produced with a plurality of lower volume blowers.

Figure 4A:
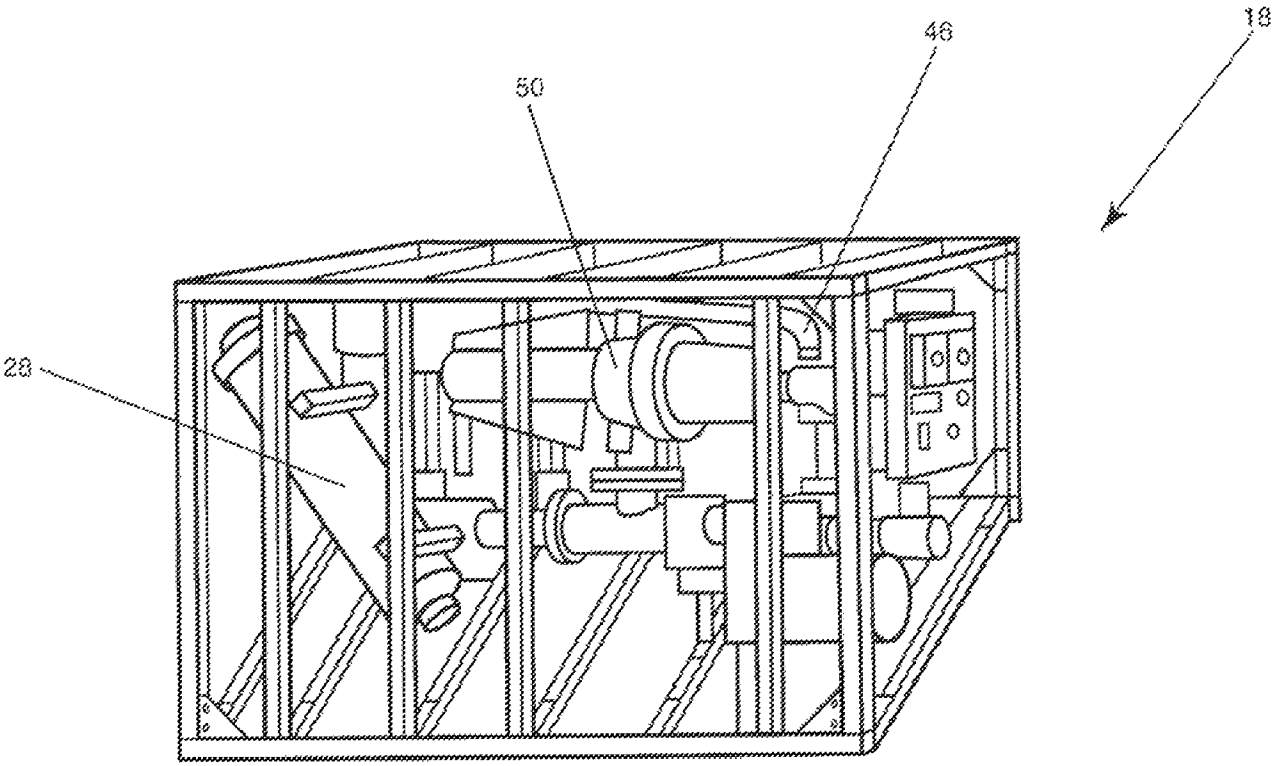
FIGS. 4A and 4B are illustrate perspective views of a preferred embodiment of the water recycling system of the present invention.
Figure 4B:
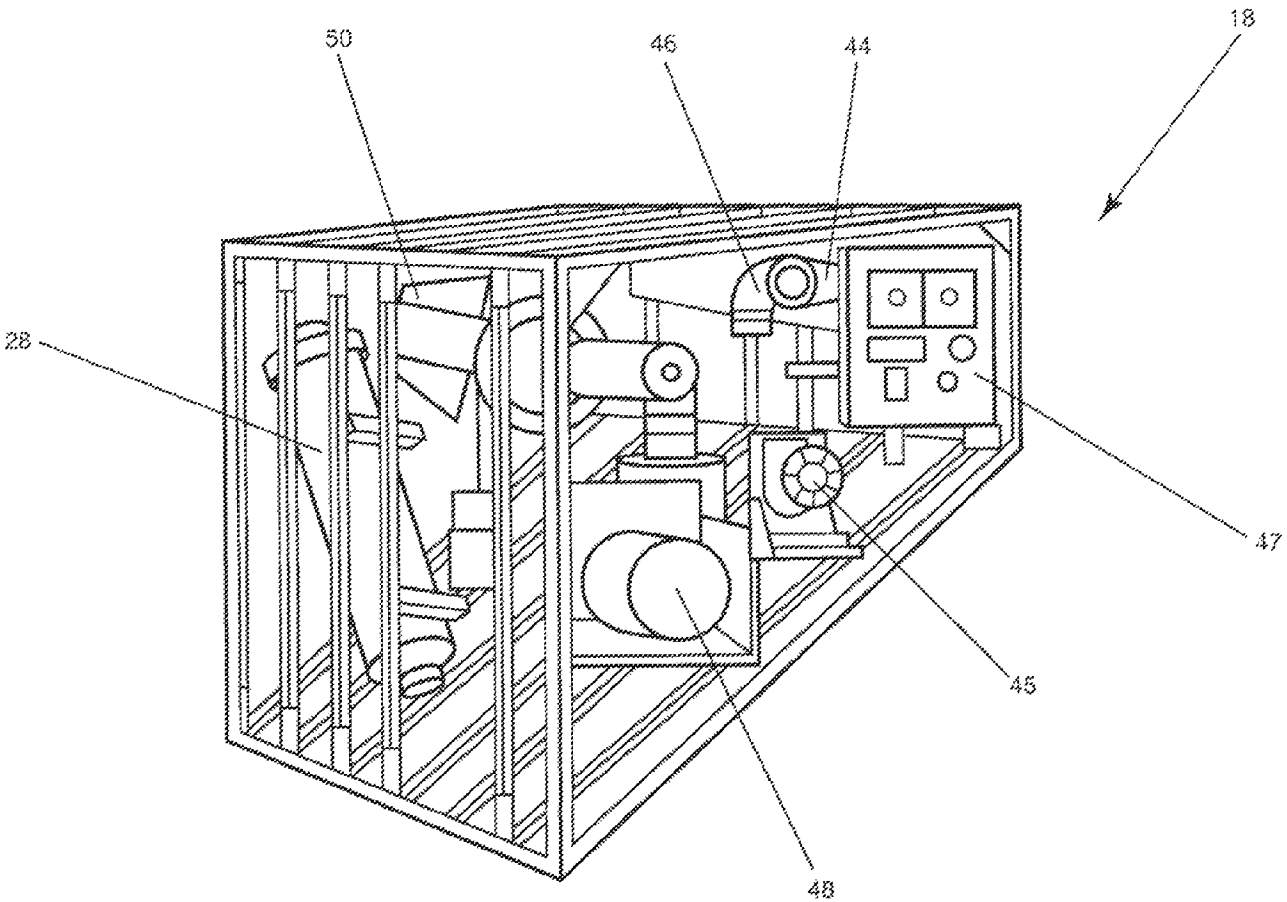
Figure 5A:
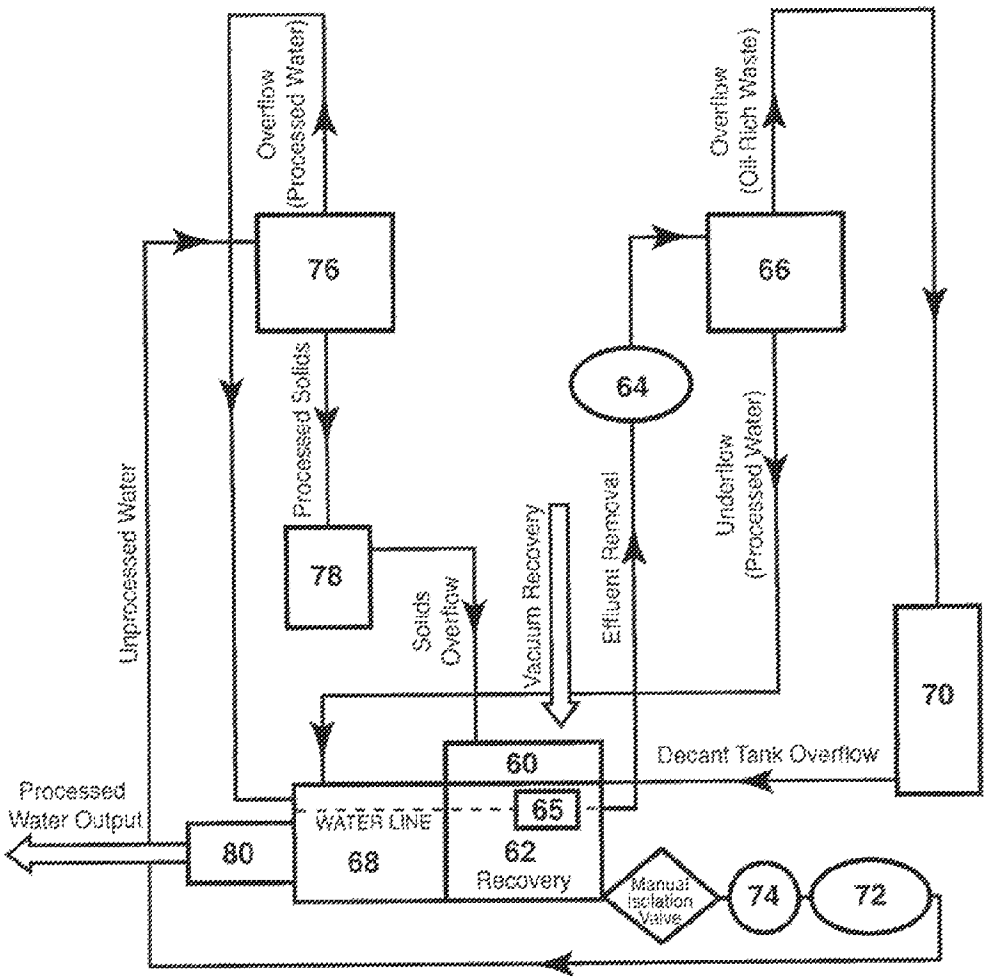
FIGS. 5A and 5B, illustrate flow diagrams identifying alternative configurations of the water recycling system of the present invention.
Figure 5B:
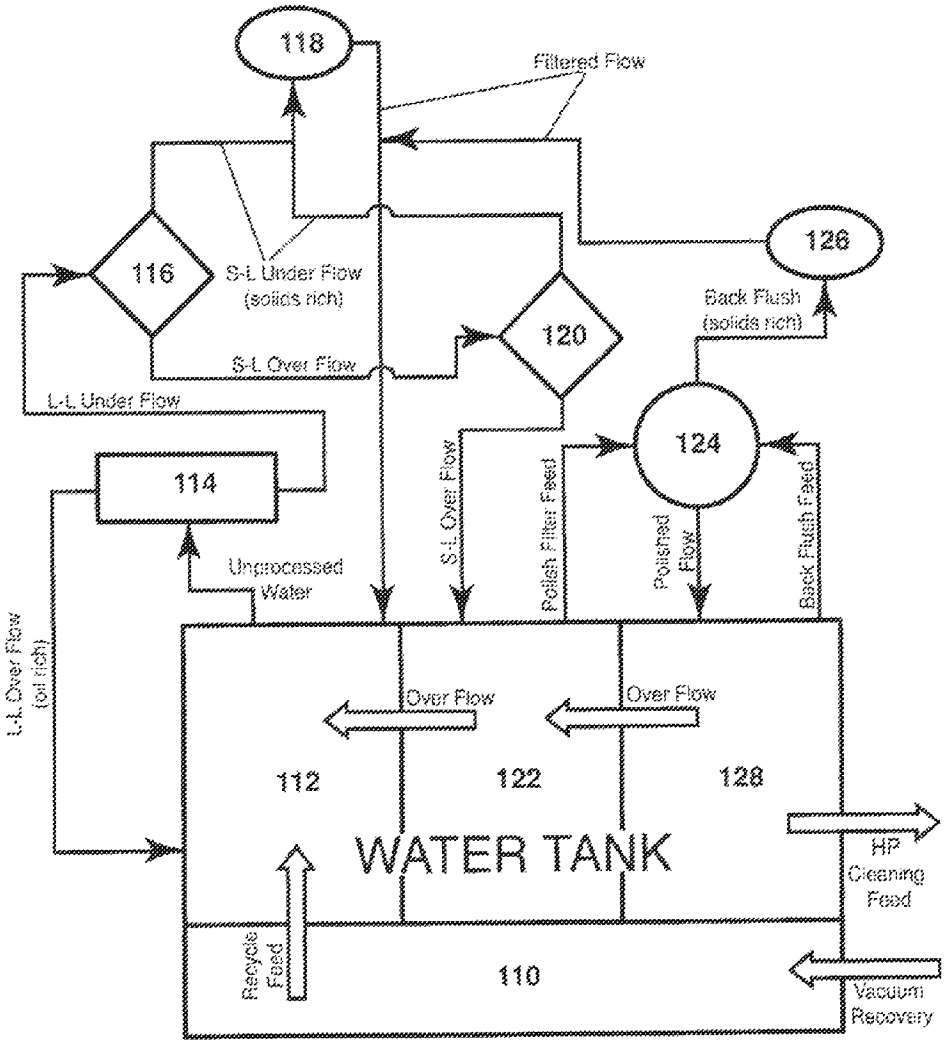

FIGS. 4A and 4B illustrate an embodiment of the recycling system of the present invention. The water and small debris flow into recovery tank 16 (see FIG. 1) before passing through liquid-liquid separator 44 and then solid-liquid separator 46. Liquid-liquid separator 44, which is preferably powered by progressive-cavity pump 45, preferably removes all liquids which are less dense than water. For example, oils and greases are preferably removed from the recovered water by liquid-liquid separator 44. While a number of skimmer-type devices can be used to separate liquids, and produce desirable results, a liquid-liquid cyclone is preferably used. Further, the order of the recycling steps is not essential. FIGS. 5A and 5B illustrate two alternative flow charts which generally illustrate consecutive steps of purification for the recycled wash water. Upon studying this application, those skilled in the art will readily recognize that the steps of purification of recycled water can be rearranged to form numerous combinations of water cleaning steps which can be used to clean the water of the present invention. However, it is preferable that each step be performed at some point. For example, the recovered water can pass through liquid-liquid separator 44 before or after passing through solid-liquid separator 46. Or, separators 44 and 46 can be placed in parallel rather than in series such that both separators simultaneously draw recovered water from and return processed water to recovery tank 16. Optionally, recycling system 18 can include solid-liquid timer module 47 which can be programmed to cycle solid-liquid cyclone 46 on and off at desired intervals.

Smaller size solids are preferably removed from the recovered water by the use of solid-liquid separator 46, which is preferably powered by centrifugal solid-liquid cyclone pump 48. While various devices and methods, known to those skilled in the art, can be used and will produce desirable results for separating solids from a liquid, a solid-liquid cyclone is preferably employed.

Automatic scanning filter 50 is preferably employed which optionally filters any remaining debris just before the recycled water enters the high-pressure pump.

The vehicle, according to one embodiment of the present invention, can also optionally be fitted with a high pressure hose and wand which is connected to an output of high pressure pump 24 such that a user can manually clean an area with the high pressure wand.

In the event that the present invention loses power, an auxiliary brake release pump is preferably provided that can disable the brakes by pressurizing the brake line so that the unit can be towed by another powered vehicle. Additionally, three or more lift points 52 (see FIG. 1) are also optionally provided. Lift points 52 can be secured to an upper portion of vehicle 10 and a center of gravity of vehicle 10 preferably resides somewhere within an area bounded by lift points 52.

Referring to the flow chart of FIG. 5A, in one embodiment of the present invention, soiled water preferably enters through the vacuum recovery and passes through screening device 60 before entering recovery tank 62. Pump 64, which can be a progressive cavity pump, preferably removes water from recovery tank 62 through skimmer 65 before passing it to liquid-liquid separator 66. An underflow of liquid-liquid separator 66 preferably flows to processed water tank 68. The oil-rich overflow of separator 66 preferably flows into waste oil tank 70. Pump 72, which is preferably a centrifugal pump, preferably pulls water from recovery tank 62 and through large solid strainer 74 before passing the water to solid-liquid separator 76. A manual isolation valve can optionally be disposed between recovery tank 62 and strainer 74. The solids water which is extracted from solid-liquid separator 76 preferably flows into solids waste pot 78. An overflow from solids waste pot 78 can optionally be installed such that the overflow returns to recovery tank 62 through screening device 60. The overflow of processed water from solid-liquid separator 76 preferably flows into processed water tank 68. In-line, scanning, self-flushing, polishing filter 80 is preferably disposed at an outlet of processed water tank 68, water which passes therethrough is then re-used for cleaning purposes. Straight filters can also be used at an outlet of processed water tank 68. In addition, one or more settling tanks can be provided to facilitate the settlement of the reclaimed water.

Referring to the flow chart of FIG. 5B, in another embodiment of the present invention, waste water preferably enters recovery tank 110 before passing to optional first storage tank 112. The waste water then preferably passes to liquid-liquid separator 114. Oil rich overflow of L-L separator 114 preferably re-circulates back into optional first storage tank 112. The underflow of separator 114 preferably travels to first solid-liquid separator 116. Waste water from the underflow side of solid-liquid separator 116 then preferably travels to optional first filter bag 118. If optional first filter bag 118 is used, then the water which passes therethrough preferably returns to optional first storage tank. The purified overflow of first solid-liquid separator 116 preferably flows into second solid-liquid separator 120. The purified overflow water which emerges from second solid-liquid separator 120 preferably passes to second optional storage tank 122 while the underflow of dirty water emitted from second solid-liquid separator 120 preferably passes through optional first filter bag 118. A polishing filter, such as self-flush filter 124 is preferably provided and draws water from second storage tank 122. The back flush from self-flush filter 124 preferably travels to optional second filter bag 126. The output of optional second filter bag 126 preferably flows into optional first storage tank 112. The purified water which does pass through self-flush filter 124 preferably flows into clean water storage tank 128 where it is held before it is passed on to a high pressure pump for re-use. Upon studying this application, those skilled in the art will readily recognize that one or more pumps can be installed in numerous places throughout the block diagram of FIG. 4B such that water is caused to flow to the various elements of the diagram. In addition, one or more settling tanks can be provided to facilitate the settlement of the reclaimed water.

The cleaning effectiveness of the present invention is far superior to the prior art with respect to its ability to restore the coefficient of friction on non-skid deck surfaces in less time. Particularly, when embodiments of the present invention are used to clean aircraft carrier decks, numerous benefits can be realized. These benefits include, but are not limited to, 1) quality of life is enhanced for persons who are no longer forced to clean large surface areas by hand with soap; 2) the elimination of soap use for primary deck cleaning enhances the environment; 3) vast reduction in water usage for deck cleaning because water can be re-used by recycling about 16 times per hour; 4) reduction in the use of salt water in spray down leads to less corrosion.

Figure 6:
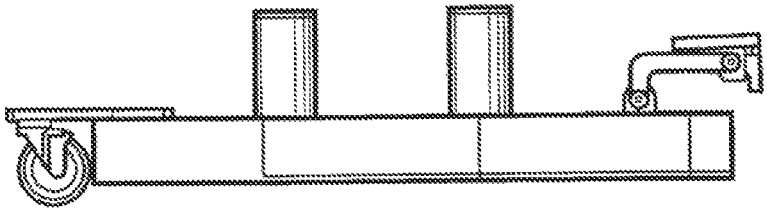
FIG. 6 illustrates a perspective view of the cleaning deck of the present invention in raised and lowered positions.
Figure 6:
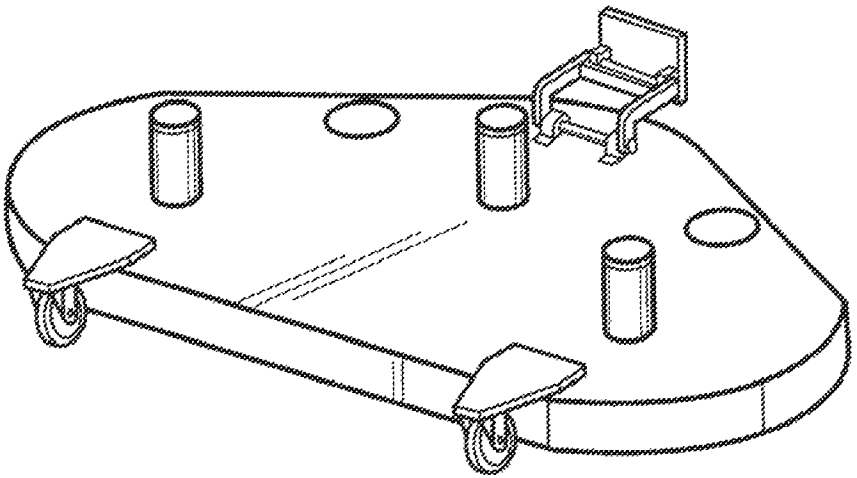

An embodiment of "floating" cleaning deck 35 is illustrated in FIG. 6. This embodiment of the cleaning system of the present invention preferably utilizes rotary bars with attached spray nozzles (e.g. about 15 degrees). Deck 35 preferably has in-position vertical articulation to approximately 10 inches (not to be confused with tilt articulator 37 illustrated in FIG. 6) in order to clear arresting cables or other obstacles. Additionally, deck 35 preferably has a stowage articulation capability to swing up for improved storage and nozzle access/maintenance.

Figure 7:
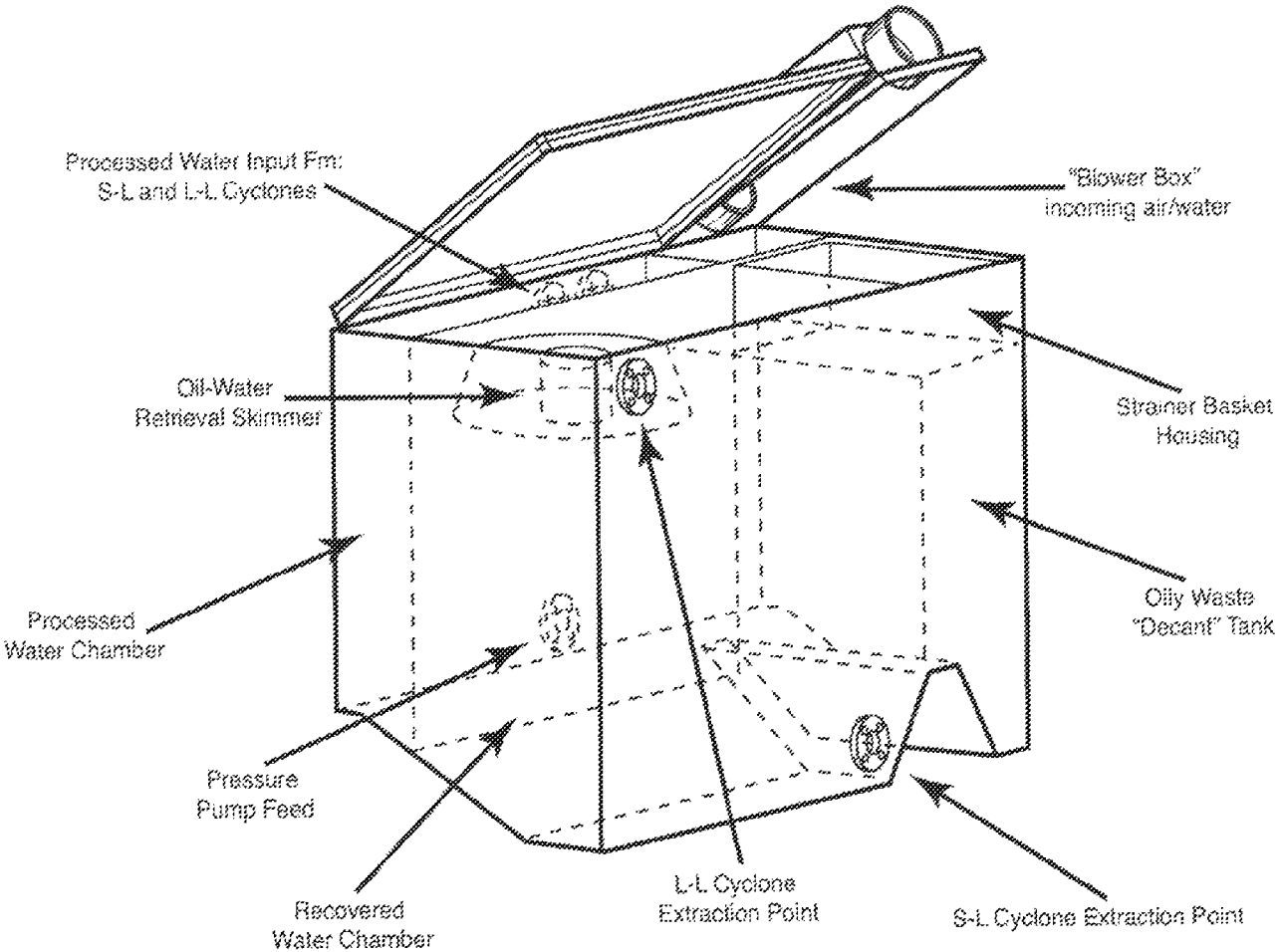
FIG. 7 illustrates a tank assembly of the present invention.

FIG. 7 illustrates an embodiment of the present invention which optionally includes processed water input 31 from S-L pump 30 and L-L pump 32; strainer basket 42; pressure pump feed 64; and processed water chamber 68.

The wash water recycle system of the present invention preferably runs in a batch mode of operation rather than continuous. Batch mode functionality offers the longest operating time based on polish filter change out periodicity. This is because the system only produces the processed water in volumes as demanded by the cleaning application. Continuous mode however would offer the ability to "self-clean" the system at the expense of increased consumable use. The mode of recycle (Batch or Continuous) is dependant on post-cleaning activities. If water use and space for waste disposal is at an absolute premium, a continuous system can be used to clean water to a greater degree over time. Since a continuous based system "overproduces" process water more solids and oils are removed. A batch mode justification would be made if the system should operate the longest time between filter maintenance or change out. The invention is capable of and has operated using both methods.

In one embodiment of the present invention, the combined water capacity is approximately 200-600 gallons based on variables in cleaning application. The variables include expected intake of solids and desired square foot productivity rate (corresponds to flow at a given pressure, i.e. the more square footage cleaned, the more nozzles needed to distribute cleaning energy). Oily waste decant tank 70 preferably holds up to approximately 60 gallons of oil waste. As illustrated in FIG. 7, the recycle system of the present invention preferably incorporates a sloping bottom combined with S-L cyclone 30 placement to encourage solids departure towards the S-L cyclone outlet 29. Oil skimmer assembly 65 collects oily water from the surface of tank 70, then delivers the mixture to L-L cyclone 32 for processing. A recessed vacuum inlet placement (not illustrated) can be used to reduce the height of tank 70, thus reducing the height of the overall vehicle. There are preferably two pumps used for cyclone operation. Optionally, S-L cyclone pump 30 which is preferably a solids-tolerant open-impeller centrifugal-pump can be used and produces desirable results. Pump 30 is preferably sized to operate continuously during vehicle operation and preferably is designed to handle semi-corrosive liquids including but not limited to salt water and solids up to about ⅛" in diameter.

Preferably, with respect to L-L cyclone pump 32, low-shear dual stage progressive-cavity pump 64 is used to retrieve water from onboard water tank 62 by way of floating skimmer 65. Dual stage functionality allows reduced rotational speed and less shear caused on the liquid being pumped. Pump 64 is preferably sized to run continuously during operation of vehicle 10.

Particularly desirable results can be achieved with the pressurized water set to a pressure of approximately 5000 psi at about 15 GPM. This parameter range is desirable because it provides cleaning effectiveness while the components needed to generate such a pressure and flow rate are still relatively small. A positive displacement triplex plunger pressure pump can be used to produce particularly desirable results.

In one embodiment of the present invention, the onboard recycle system should be preventatively maintained by removing solid and oil waste from the vehicle. The separate solid-liquid and liquid-liquid cyclone systems preferably denote the two separate offloading requirements for the vehicle after a cleaning cycle has been completed. The oil waste is preferably contained in the "decant" tank 70 where a hose can be connected for offloading into the oily waste holding tank (e.g. on a ship). The solid waste is contained in the S-L cyclone "grit-pot" 78 and is retrieved by a detachable grit pot (assuming another is on hand) or a bucket container put in position (below the grit pot) while a ¼ turn valve is turned. The slurry tank is also optionally equipped as a self-dumping hopper in applications where large volumes of solids are expected. This is applicable in municipal and airport environments or where large volumes of solids are encountered. The solids system is also equipped with clean out jets and a pumped system to aid in effective solids slurry offload.

The pressure cleaning and recycle system are preferably activated and deactivated via a single switch. The switch actuates vacuum blower 26 and rotary members 36. A clearly visible two state indication lamp is preferably used for operation status of rotary members 36. In the event of stop-standing, the operator is preferably trained to recognize that the unit is actuated and it is thus necessary to switch the cleaning system off. The foregoing invention can also optionally include a simple interlock system that uses the vehicle travel speed to determine the operation status of the cleaning/recycle system. The mechanism can be a simple gate logic circuit where the pressure system can be operated when the vehicle is traveling greater than a predetermined speed and the switch is in the on position. Systems equipped with a higher power per square foot capability (IE rubber removal, paint removal) may have an interlock built in due to the damage possibility being higher than that of a machine designed just for cleaning in a municipal or street environment.

The use of a cyclone permits a very large amount of solids and oil to be processed without attention to the cyclone devices, as would be the case if a filter were used. The cyclone method of separating solids and oil from recovered wash water is effective and is preferably a component in the wash water recycle system. Water quality results illustrate that the levels of oil and solids in treated water using cyclones are close to acceptable discharge and recycle levels. A fine "polishing" stage self-flushing filter is preferably incorporated into the apparatus. The advantage to the system is that the final stage filter is singular in size and number of units because the cyclone is acting as primary staged filtration in advance of the polish filter. The particle size distribution of influent immediately before the final filter is similar to influent after a bank of filters successively sized. This results in the ability to use a single filter element (self flushing and non self flushing) in its desired final size. In this case the filter is generally sized at 5-microns.

Figure 12:
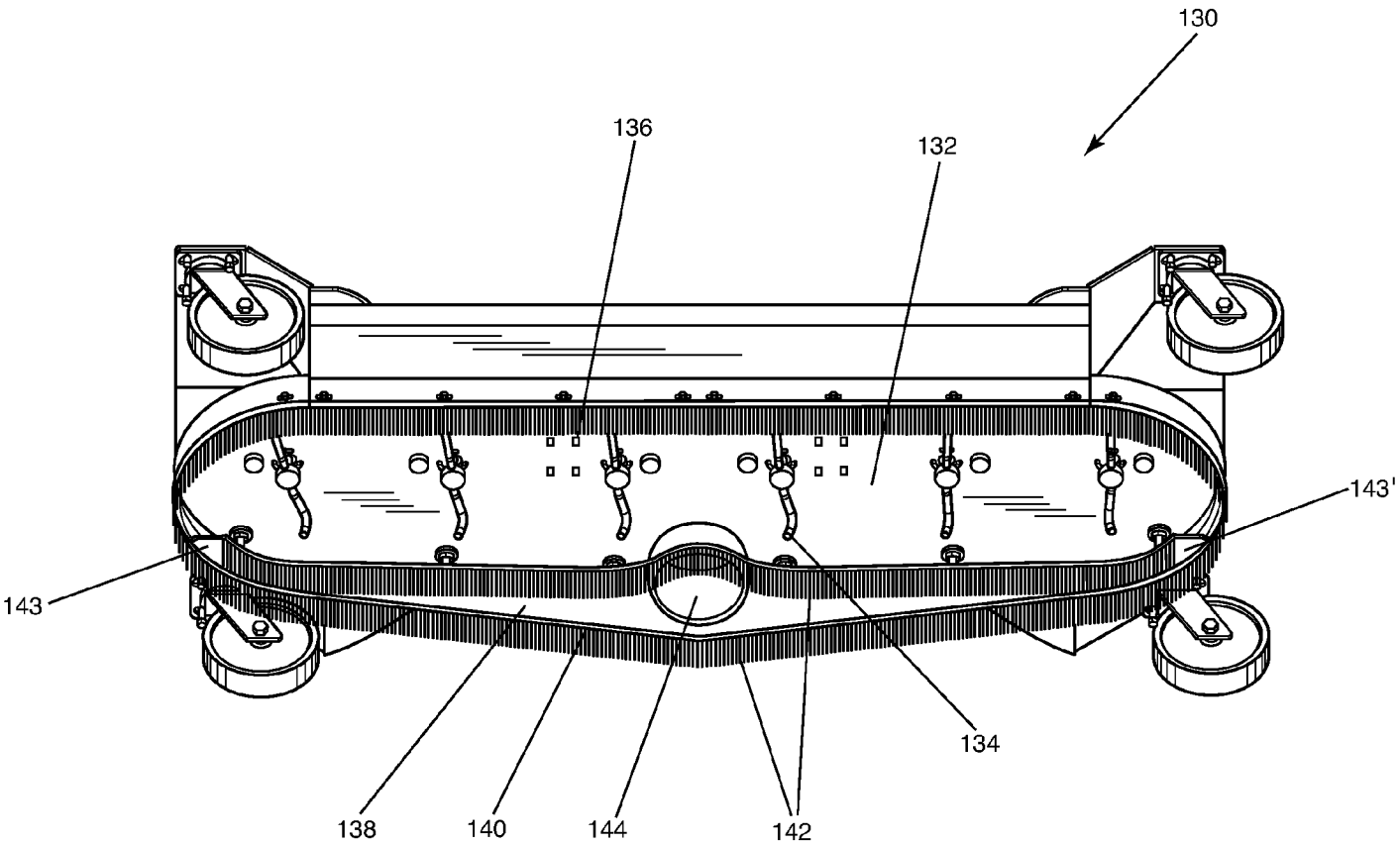
FIG. 12 illustrates a cleaning deck embodiment of the present invention with membranes between the brushes.
Figure 13:
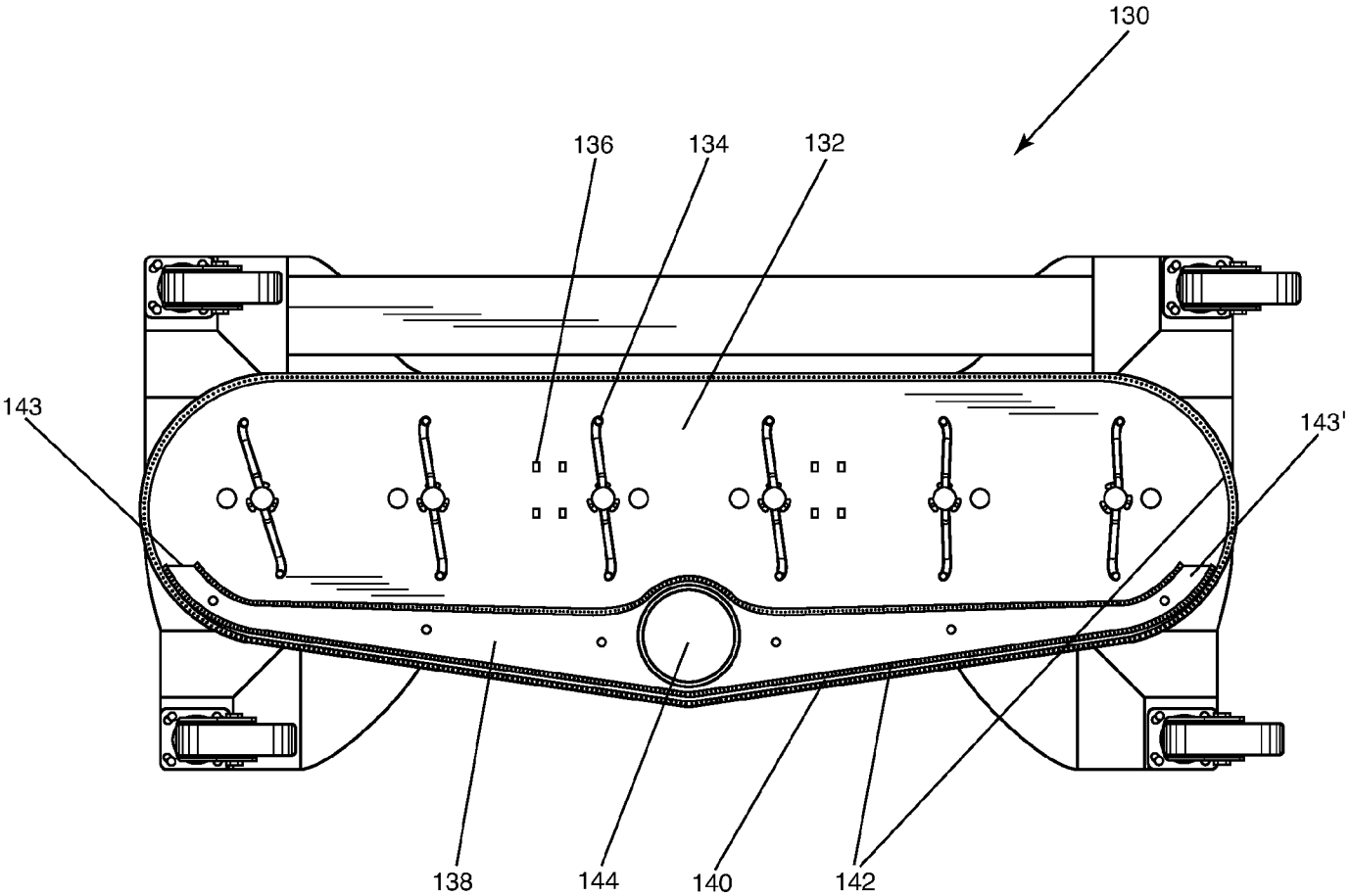
FIG. 13 illustrates a bottom view of the cleaning deck embodiment of FIG. 12.
Figure 14:
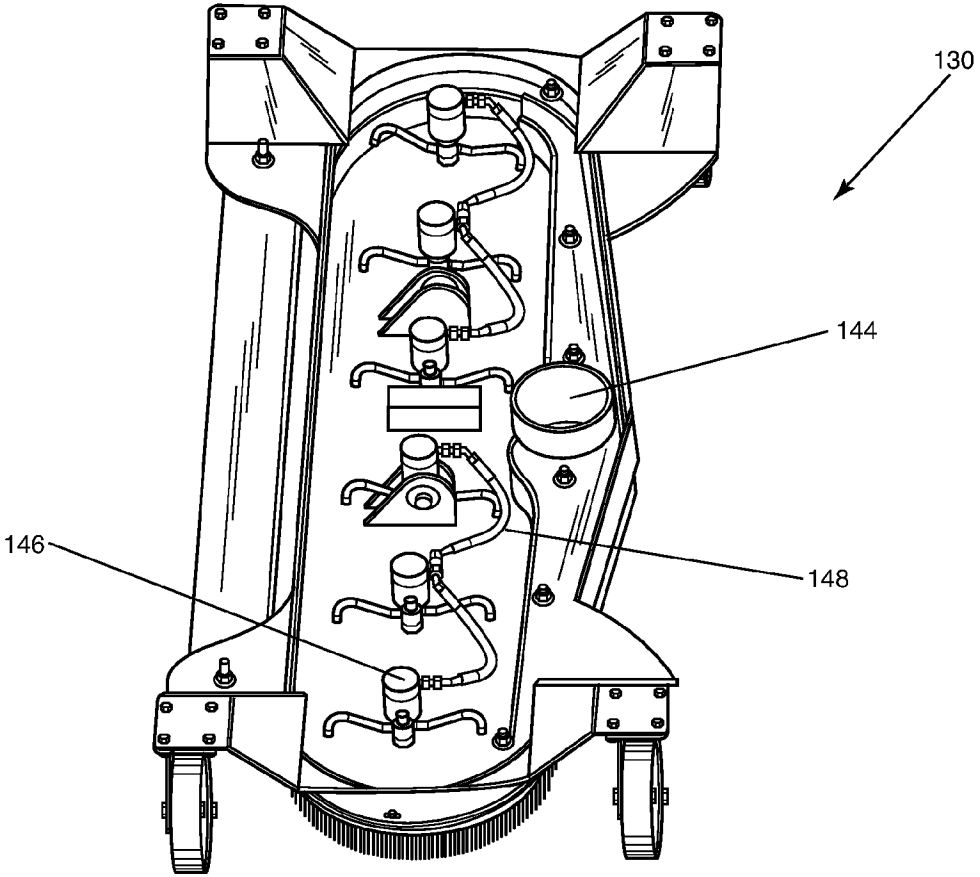
FIG. 14 illustrates the cleaning deck embodiment of FIG. 12.

FIGS. 12 through 14 illustrate different views of yet another embodiment of the present invention. This embodiment of the present invention preferably comprises obstacle clearing/cleaning deck 130. Deck 130 preferably includes solids and liquids recovery while simultaneously providing the ability to maintain adequate obstacle clearance from about ½" up to about 2½". For specific applications the obstacle clearance capability could be scaled to about 6". The cleaning/clearing system of this embodiment preferably includes, but is not limited to: surface 132 of deck 130, water sprayers/nozzles 134, inlet holes 136, separating membrane 138, brushes 140, brush skirt 142, vacuum nozzle 144, flow distribution/equalizer ports 143 and 143', and air/water inlets 148.

In one embodiment, brush skirt 142 (FIG. 12) preferably comprises one or more brushes 140, which are most preferably made from nylon or other similar durable material and at least partially surrounds the circumference of deck 130. Brushes 140 preferably at least substantially surround deck 130. Brush skirt 142 allows an adequate flow of air through to accommodate separating membrane 138 which is most preferably located directly behind cleaning chamber 132 as illustrated in FIG. 12. Cleaning chamber 132 preferably comprises sprayers/nozzles 134.

Figure 20:
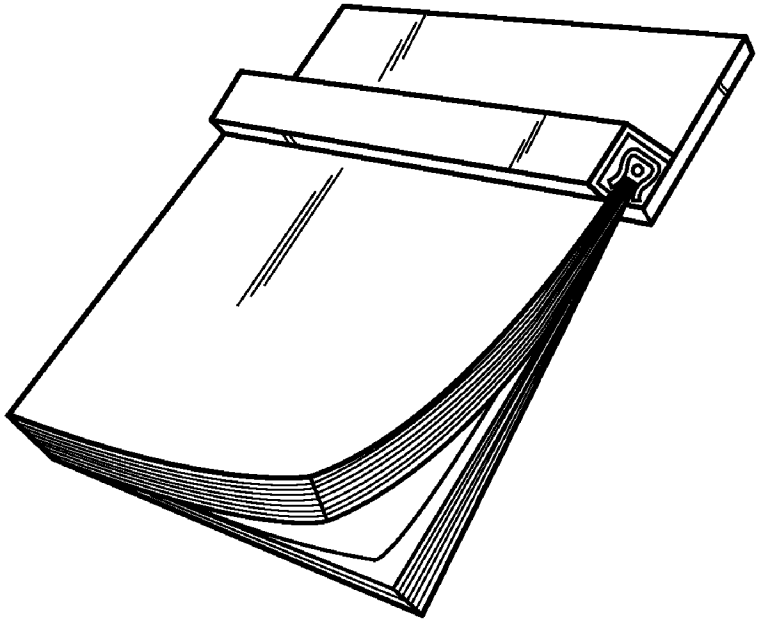
FIG. 20 illustrates membrane inserts located in the middle of the brush.

Embodiments of the present invention preferably have a number of different capabilities. For example, an embodiment of the invention preferably performs both duties of a cleaning deck including but not limited to containment and recovery of solids and liquids while retaining the ability to clear surface obstacles or protrusions. The present invention optionally uses internal-to-the-deck flow-equalizer ports 143 and 143' to balance containment and recovery functions without excessive need for vacuum blower power. Flow equalizer ports 143 and 143' allow for effective containment functionality without passing excessive flow between brush skirts 142 (FIG. 13). Swivels 146 optionally bring needed containment air from the side portion of deck 130, which is often neglected due to the front-to-back fluid flow. In one embodiment, brush 140 functionality allows deck 130 movement in multiple directions and over obstacles without damage or contact between deck components and the cleaning surface. Optional membrane inserts, shown in FIG. 20, in brush 140 can be used to fine tune air flow in the case of reduced vacuum/flow capabilities. The membrane inserts can be made of multiple materials such as EPDM, polyethylene, and polypropylene based on resistance to oils or other specific chemical resistance. The membrane inserts, as illustrated in FIG. 20, are preferably placed in the middle of brush 140. Filaments are preferably located on the outside of the membrane inserts. The membrane functionality is based on letting flow in at the bottom of brush 140. The membrane is preferably shorter than the filaments. The distance between the beginning of the membrane and the end of the filament is preferably between approximately 0.25 and 1 inches. Input air from the exterior of the deck is most preferably passed near the work piece instead of the inlet channels or holes. This creates a more efficient use of process air power. Inlet ports are more tolerant to brush wear as it relates to recovery and containment performance. Additionally, this embodiment optionally provides containment and recovery functionalities through a linear air-path progression from the front to the rear.

The embodiment of the present invention comprising brush shirt 142 and sprayers/nozzles 134 preferably allows effective solids and liquid recovery from a flat surface by virtue of extending the water/solids entraining air flow as close to the surface as possible without excessive pressure drop. This recovery functionality is common to vacuum applications however, the extended brush nozzle system provides this recovery performance while allowing for excellent obstacle clearance. Surface cleaning deck 130 provides a plurality of functionalities, including but not limited to separate functionalities. A functionality of the embodiment can be cleaning fluid containment. Deck 130 preferably contains the majority of sprayed water and resulting spray bounce. Alternatively or in conjunction with cleaning fluid containment, deck 130 recovers cleaning liquid and produced solids on the surface. This embodiment can optionally use pressure/flow equalizing ports 143 and 143' to allow both functions to be served by apportioning needed containment flow through internal-to-the-deck equalizing ports 143 and 143' and by feeding vacuum nozzle 144 with adequate flow to produce air/water entrainment especially along the brush line in front of separating membrane 138. This functionality is preferable if vacuum nozzle 144 is a non-positive displacement type unit that is performance hindered if excessive back pressures are found in cleaning deck 130 (FIG. 14). In contrast, a system with a single membrane (without interior equalization ports or with external air input ports) would produce significant back pressure on the vacuum recovery system without the interior equalization ports. Such a system would recover material well however it would starve the containment functionality of the cleaning portion of the deck resulting in escaped cleaning water from deck sides relative to a forward direction of travel.

Referring to FIGS. 13 and 14, flow equalizing ports 143 and 143' distribute pressurized flow to both the containment and recovery tasks. This embodiment allows input of containment air to deck 130 in a manner that supports containment of the cleaning spray as air is ingested around the perimeter of the forward deck during the cleaning process. Inlet holes 136 and inlets 148 also reduce the criticality of brush 140 wear and separating membrane 138 distance gap as it relates to recovery performance. Optionally, membrane inserts, see FIG. 20, can be located between brush skirts 142 and stop short of the cleaning surface to provide an air opening situated around the perimeter of deck 130. Separating membrane 138 controls the "inlet" size, thus producing substantially predictable containment velocities around deck 130 while brush skirt 142 without separating membrane 138 provides a permeable and flexible yet effective barrier against cleaning nozzle spray escapement. Other systems that rely on the gap around the perimeter of the cleaning deck are susceptible to spray containment problems. The result is that commonly an impermeable membrane is used and it is extended to the surface. While this method contains very well it does not provide an adequate air intake. Therefore, such an invention can have holes 136 on top of the deck or side channel inlets can optionally be added to feed the recovery air needs of the vacuum system.

The addition of membrane 138 between brushes 140 extends approximately 1 to 1¾", such that it is approximately ⅜"-1" short of contacting cleaning surface 132, forms an air inlet to brushes 140 directing the majority of air underneath, thus efficiently using the vacuum flow and pressure directly on the work.

Figure 15:
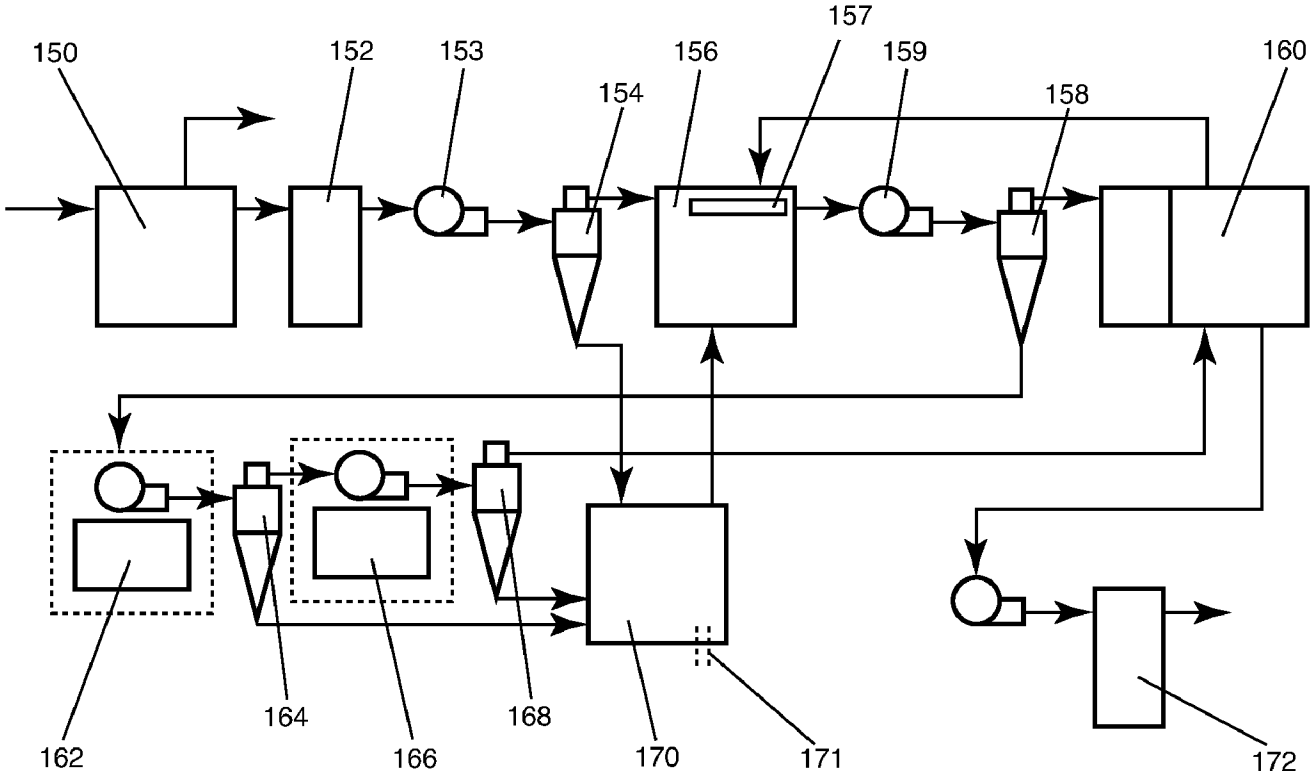
FIG. 15 illustrates a schematic diagram of an embodiment of the process system.

FIG. 15 illustrates an embodiment of the recycle system. This embodiment preferably comprises air water separator 150, inlet strainer 152, S-L 1 154, stage 1 tank 156, L-L 158, decant/stage 2 tank 160, optional pump 162, S-L 2 164, optional pump 166, S-L 3 168, settling tank 170, and final filter 172. In this embodiment, the clean water tank is deleted and the decant drains into stage 2 tank 160 via a "barometric leg" to prevent oil contamination.

Optionally, the embodiment can have strainer 152, which is positioned before pump 153, thereby reducing pump wear by allowing settleable solids to drop into a waste container before they can reach the general recycle module.

Alternatively, L-L 158 and the decant portion of decant/stage 2 tank 160 can be deleted. In this embodiment, pump 159 remains and provides power to the S-L cyclone circuit. A float based inlet in Stage 1 tank 156 prevents oil transfer to the rest of the system. In this embodiment, the oil would remain in Stage 1 tank 156 and the float based inlet has an unconventional function. The float based inlet is preferably attached to an inlet (to feed pump 159) underneath the surface approximately 2"-10" so as to always draw water from stage 1 tank 156 beneath the presumable oil level.

This recycle system reduces complexity and avoids overprocessing of water through final filter 172. This arrangement improves the final filter life by 20-30% because only water used by high pressure pump 24 is filtered, unlike known systems which must overproduce to keep up with demand. A non-positive displacement pump can be used in this case.

Inlet cyclone (S-L 1) 154 can be added to progressively categorize solids in separate waste streams, (for example coarse, easily-dewatered, solid waste other downstream cyclones optionally protect final filter 172 from a wide range of fine solids that tend to cause premature failure in polishing filters). Inlet cyclone (S-L 1) 154 (FIG. 15) is preferably driven with low energy and its separation parameters are adjusted so that large particles can be separated out (cleaning coarse solids out of tanks can cause excessive water use or manual labor because of their dewatering properties). Inlet cyclone 154 is preferably configured with large orifice sizes to make this cyclone resistant to plugging, whereas a tighter downstream cyclone would have a propensity to plug if exposed to the coarse and fine solids characteristically found in the incoming water stream. This system concentrates solids to a single solids settling tank 170 where a user can flush the tank and solids by a high flow injection of Stage 2 water in settling tank 170.

As illustrated in the embodiment of FIG. 15, in order to recycle water effectively, the process system must protect the high pressure pump from solids or prevent oil contamination from being reintroduced to the workpiece. A combination of successive S-L cyclones are preferably used to take the solids intake in the water stream and break it down from coarse to fine solids in a similar way that filters work in that a broad solids size range requires a compliment of progressively-smaller filter screen sizes to separate solids out evenly. A specific arrangement is necessary to recycle a broad range of solids/oil contaminated influent. The process starts with air-water separator 150. Followed by inlet strainer 152 (between approximately 600 to approximately 1000 micron mesh depending on application). The material is then pumped directly to coarse-cut inlet cyclone (S-L 1) 164 which is designed to move coarse settleable solids to the main solids containment tank before they can settle anywhere else in the system. This functionality focuses solids to a single containment vessel in the system downstream of the recovery process. In this embodiment, S-L 1 154 is powered by pump 153 used to evacuate air-water separator 150 and solids inlet strainer 152. Stage 1 tank 156 is filled by the overflow of S-L 1 154 and further processed by a higher pressure series set of cyclones. The first higher pressure cyclone in the series is Liquid-Liquid unit (L-L 1) 168 used to drop out oil. Stage 1 tank 156 preferably is equipped with skimmer 157 so that L-L 1 158 can manage oil contaminates to decant oil holding tank. Please note that tank 160 is really two tanks. The two tanks are preferably interconnected by a barometric leg to prevent oil contamination while still allowing overflow from decant to the stage 2 portion (right side). L-L 1 168 can operate at relatively high pressure so that pump 159 can produce enough separation energy to also power S-L cyclones 164 and 168 for a fine solids capture.

Run-dry functionality can be used as a method that allows for water level control in air-water separator 150 (see FIG. 15) where evacuating pump 153 runs in excess of predicted water intake flow rates. The use of evacuating pump 153 in this application maintains the vacuum separation of separator 150. A water pressure sensor scheme can regulate this method by turning off pump 153 in a low-pressure scenario and momentarily turning to "test" the air water separator liquid level. In the case of no fluid, pump 153 will continue the testing until pressure is built. Pump 153 will run continuously (while the vacuum system is activated) while pressure is made. An alternative method comprises a level sensing and a variable speed pump control loop that allows for steady level control and effective evacuation without pump cavitation or excess water level. The pump scheme can be a 2-stage system that can be set to pump at a low setting, just under the low setting of the high pressure (HP) water pump output. A liquid level sensor can be used to modulate the pump speed above incoming flow rate to overcome the rising volume of recovery water in the underflow chamber. Once the water sensor detects a decreasing level, the flow rate of the underflow pump can be used to reduce the baseline flow rate. For a LL-SL application, a low-shear positive displacement pump is desired to reduce chop on oil droplets.

Figure 18:
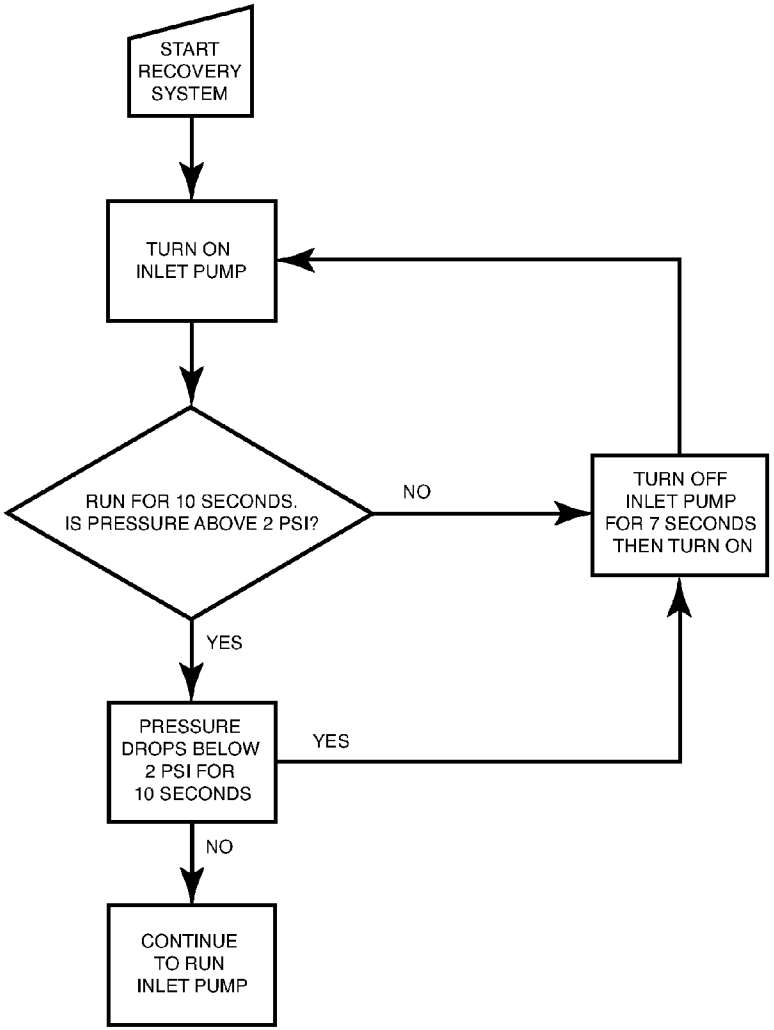
FIG. 18 illustrates a flow diagram with the logic functionality of an air-water separator and evacuator pump system.

FIG. 18 illustrates logic functionality of air-water separator 150 and evacuating pump 153 system. In one embodiment of the present invention, a simple algorithm is used to modulate evacuating pump 163 based on water height. This system preferably comprises a single water pressure gauge. As illustrated in FIG. 18, the recovery and recycle system is turned on, then pump 153 is turned on. Pump 163 runs for approximately 5-15 seconds and preferably approximately 10 seconds and then based on a pressure measured from a water pressure gauge, if the pressure drops below approximately 2 psi for approximately 10 seconds, pump 153 is turned off long enough to build proper pressure, preferably approximately 7 seconds and is then turned back on. As long as the pressure remains above approximately 2 psi, pump 153 will continue to run.

Figure 19:
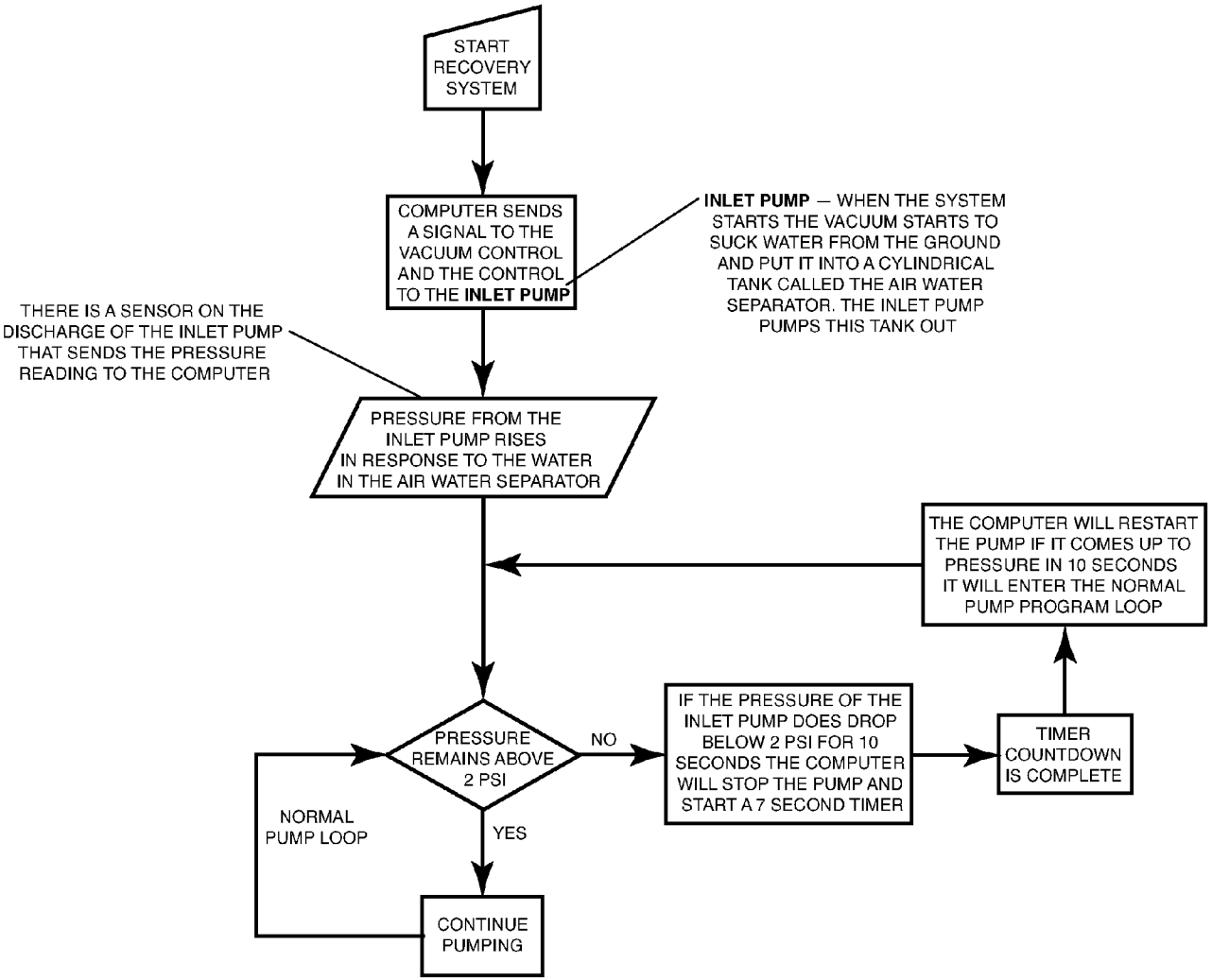
FIG. 19 illustrates a flow diagram for controlling an inlet pump that removes water from an air-water separator.

An alternative system is illustrated in the flow diagram in FIG. 19. In this embodiment, a computer sends a signal to the vacuum control and the control to pump 153. When the system starts, the vacuum begins to suck water from the ground and puts it into air-water separator 150. Pump 153 then pumps the contents of air-water separator 150 out. Pressure from pump 153 rises in response to the water in air-water separator 150. There is preferably a sensor on the discharge of pump 153 that sends the pressure reading to computer. If the pressure drops below approximately 2 psi for approximately 10 seconds, the computer will stop pump 153 and start a timer. Once the timer countdown is complete, the computer restarts pump 153 if it comes up to pressure within approximately 10 seconds, and it enters the normal pump program loop. As long as the pressure remains above approximately 2 psi, pump 153 remains on and continues to pump.

Skimmer 157 preferably floats on top of the water level in stage 1 tank 156 and uses a diversified flow technique that draws water from the surface and from the sub-surface. This functions as an oil-surge protector so that LL-1 158 is not overwhelmed with oil content in the case of a surge of oil introduced into vehicle 10. The surge protection prevents oil concentrations input to LL-1 168 feed from being too high. In a case where LL-1 158 is overwhelmed it rejects oil from the overflow (normal operation) and the underflow, thus contaminating the downstream process.

This embodiment allows for optionally eliminating the clean water tank from the process. By using a centrifugal or other non-positive displacement pump at stage 2 160, water can be fed on demand through the polish filter to the high pressure pump. This on-demand functionality simplifies the overall tank design as well as reduces the overall amount of water needed to go through final filter 172. This functionality can increase the vehicle run time between polish filter change outs by up to approximately 30% compared with an overproducing type system that fills a clean water tank which then overflows back to stage 2 tank 160 or stage 1 166 (see FIG. 15).

Embodiments of the present invention include solids settling tank 170 that has technology to "self-clean" for gross solids offload whereas other tanks in the system are not equipped with this ability to self-clean. Solids settling tank 170 is the end point for the fines-processing cyclones. The end goal of solids settling tank 170 is to reduce disposal footprint: solids are as concentrated as possible with as little liquid component in a solids offload and post-solids offload management scenario. The concept of solids settling tank 170 is that solids-liquid waste can be segregated to a single container (e.g. a 55-gal drum) and the remainder of the waste in the vehicle is largely liquid waste. Solids settling tank 170 is designed to handle solids buildup whereas buildup in other tanks would produce extra mucking-out work and disposal footprint. Tank 170 preferably uses pump-produced slurry jets (not shown) to agitate the area immediate to tank exit hole 171.

Referring to FIG. 15, solids settling tank 170 can allow enough quiescence for the underflow to prevent excessive re-introduction of once-settled solids into the system due to the fact that underflow flow rates are significantly lower than overflow rate in solid liquid cyclones. Tank 170 and its settling and agglomeration properties preferably allow an open underflow mode of operation without the excessive water volume buildup associated with open underflow. The open underflow functionality also produces increased solids separation efficiency critical to the ability to recycle water continually throughout the cleaning mission timeline. The buildup of separable yet uncontainable solids as time progresses through the cleaning timeline is challenging because once the solids reach a certain percentage, the cyclone begins to reject solids through the overflow and plug the final filter. Settling time and or the time it takes solids to escape from the settling tank assists with the overall solids concentration in the system thus allowing cyclone effectiveness in reducing solids content for the final filter feed.

Figure 16:
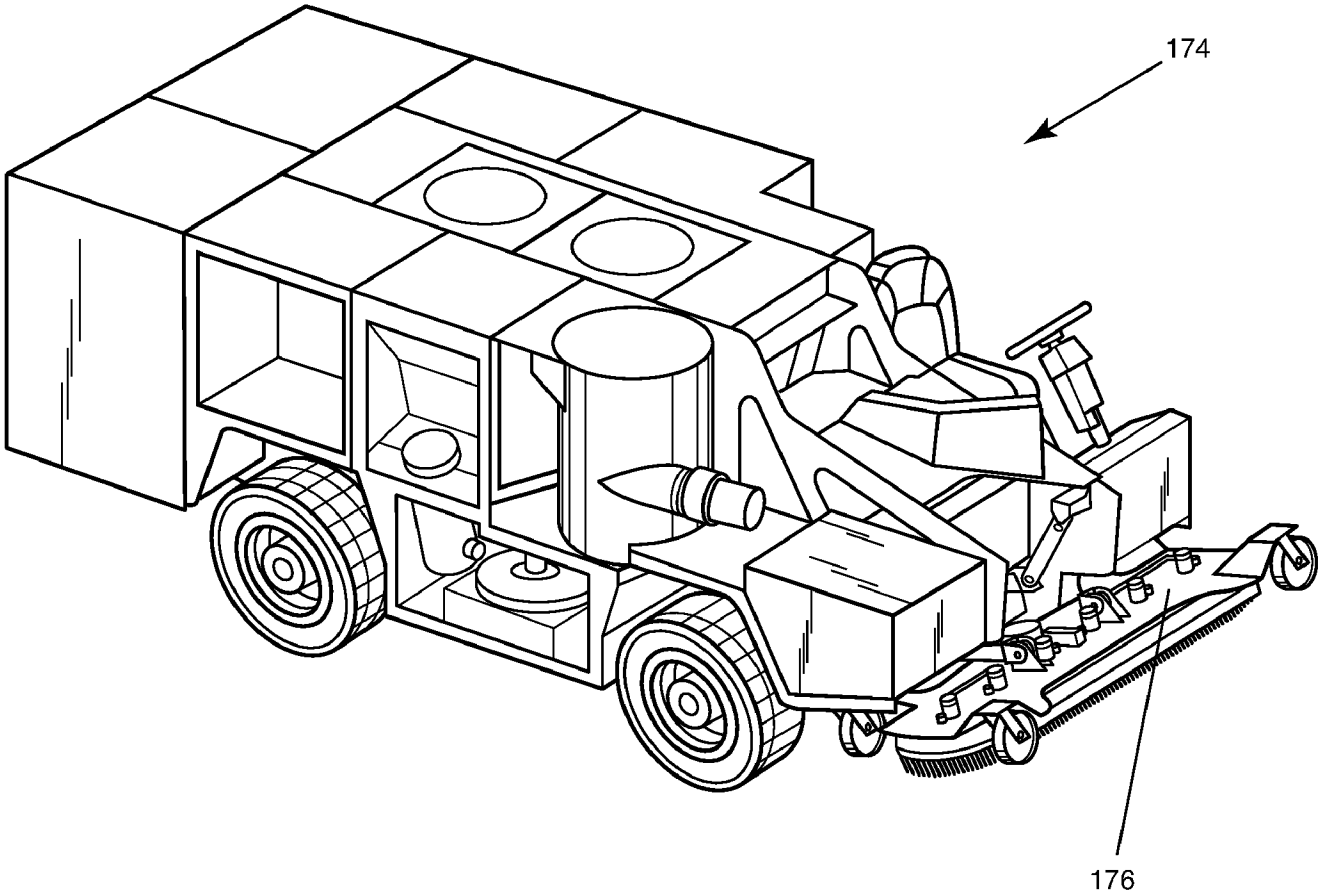
FIG. 16 illustrates a side view of an embodiment of the present invention.

FIG. 16 illustrates the invention from a perspective view. This embodiment of surface cleaning vehicle 174 illustrates the outside of the vehicle with the above-mentioned systems and embodiments enclosed within the vehicle and on surface cleaning portion 176.

Figure 17A:
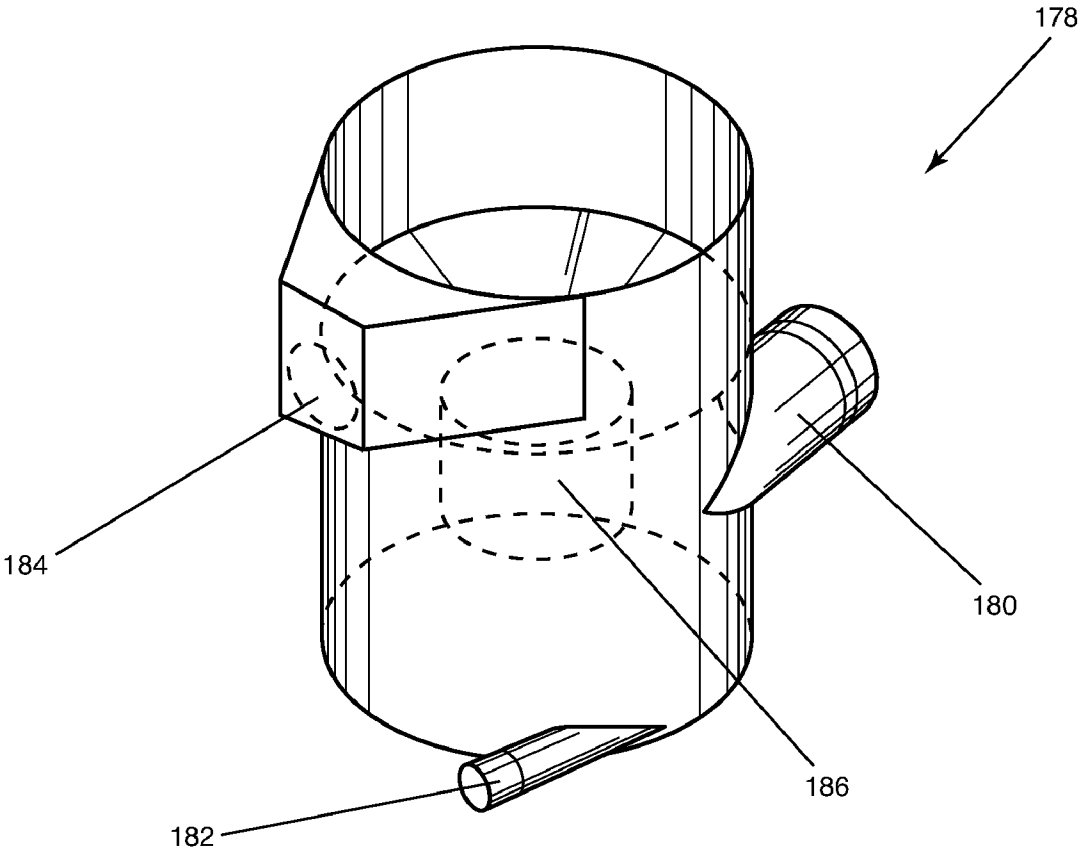
FIGS. 17*a*, 17*b*, and 17*c* illustrate an embodiment of the solids settling tank.
Figure 17B:
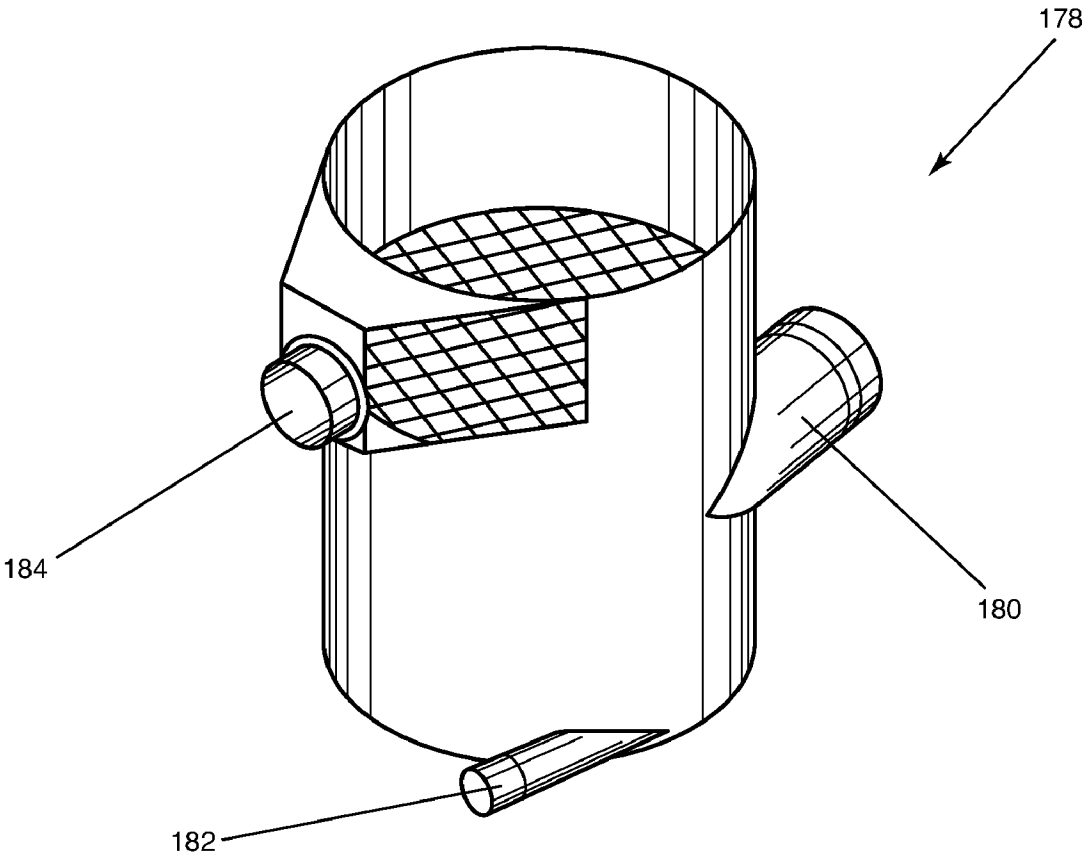
Figure 17C:
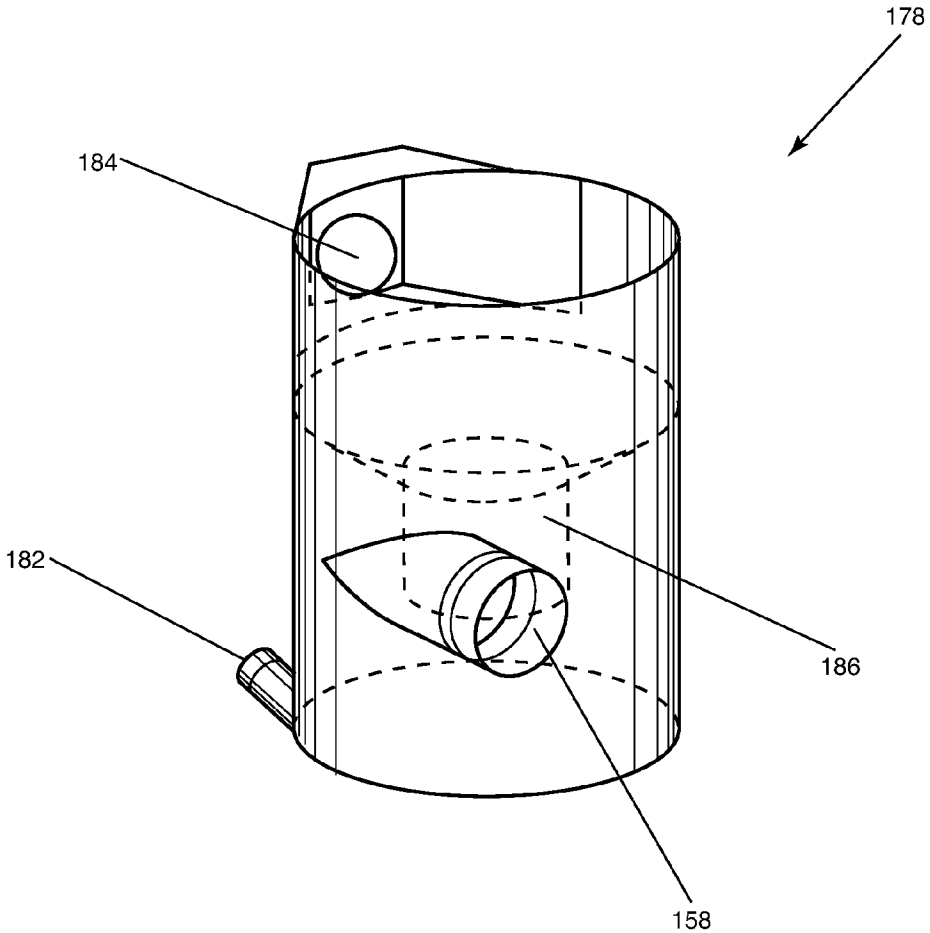

Embodiments of the present invention preferably comprise an air-water separator that can be used in a recycle system as illustrated in FIGS. 17*a*, 17*b* and 17*c*. The recycle system can use air-water separator 178 to separate solids/liquid particles from recovery air. Air-water separator 178 returns air which is relatively free from liquids and/or solids to blower 26. The air is most preferably at least substantially particulate free to prevent blower impeller wear and to prevent spillage of process water or solids in the blower exhaust. Air-water separator 178 can have a plurality of functions, including but not limited to, separating liquid and solids from air, thus maintaining the closed-loop functionality of the recycle system or using a "pump-evacuated" underflow to isolate the vacuum effect of the blower from the rest of the system's tanks. A pump, preferably a positive displacement pump, is used to isolate the vacuum effect from the rest of the recycle system whether it is pumping or not. A pump control algorithm is used to operate the pump based on the need to remove water from the air water separator. The pump control algorithm is driven by a pressure sensor just aft of the Inlet Pump. The vacuum system is turned off as a safety precaution if inlet screen 152 is full; and/or if water is sensed in the higher regions of the underflow chamber (indicating that the pump is not evacuating enough water relative to the incoming water loading of the recovery circuit) and/or using a coalescing demisting pad to remove tramp water droplets from the air stream.

Air-water separator 178 preferably comprises air-liquid/solid inlet 180, liquid/solid pump-out plus vacuum isolation port 182, air exit port 184, and cyclone apex cone 186. Air-water separator 178 can use a closed underflow which isolates the vacuum from the rest of the system. Vacuum isolation port 182 can allow for flexibility in water-tank construction and reduces the criticality of fluctuating water levels relative to dewatering functionality. The closed underflow configuration preferably includes level sensing technology and a pump interface to remove liquid and solids material. The pump can be attached to a control loop with the level sensing technology to "keep up" with the increasing liquid level as water and solids are ingested. An optional solids storage and removal drum (or coarse solids handling bag) can be added to air-water separator 178 to enhance the coarse solids handling of the system. The drum attaches below air-water separator 178 and fills with water initially and as solids are ingested in the system, the solids displace the water up to the drum's capacity (roughly from 5-40 gallons). This feature would be selected for systems that see a large intake of solids thus having the need to remove dewatered solids in larger format than inlet strainer 152 (FIG. 15). A bag based system can aid in dewatering the solids being removed from the vehicle.

One embodiment of the present invention comprises an optional bulk recovery device that can be used in conjunction with water-based cleaning to accomplish bulk waste cleaning and recovery. Water based surface cleaning vehicles are generally effective in recovering a wide range of material. The recovered material can range from fine solids to bulk coarse solids and Liquids in varying volumes. Large volumes of waste and bulk materials are not usually compatible with liquid based waste management and storage commonly associated with water based vehicles. The recovered bulk material usually requires secondary handling or separation at the end of a cleaning mission. Separation or classification of this waste material is essential to cost effective waste management.

The bulk recovery device in conjunction with a water based cleaning system can do the following:

1. Protect the water-based circuit from large influxes of liquids and solids (oil spills, or large amounts of gravel).
2. Afford the benefits of using a mechanical and water based cleaner with a single piece of equipment and single pass.
3. Aft water based cleaning can provide "dustless" operation compared with other bulk recovery devices that do not use water to suppress vacuum exhaust.

The optional bulk recovery device preferably achieves much of the bulk cleaning needs without stressing the waste management weaknesses of a water-only based system. A novel integration of the "Dry-Cycle" (bulk recovery) and "Wet-Cycle" (water-based cleaning system) is accomplished by using a single blower and routing the incoming "Dry Cycle" blower exhaust to Wet Cycle air-water separator 178. This unique integration not only relieves the separate bulk and liquid waste management issues, it also addresses a common weakness in Water-Free systems. This weakness involves reintroducing small solid particulates into the atmosphere via vacuum blower exhaust. There are many systems that use varied means of reducing the particle pollution. Filters, air regeneration, and water spray down are common methods to suppress dust generated during Dry-Cycle recovery. The Dry-Wet system allows for bulk liquid and solid recovery while affording dust suppression attributes already associated with water-based recovery.

Figure 8:
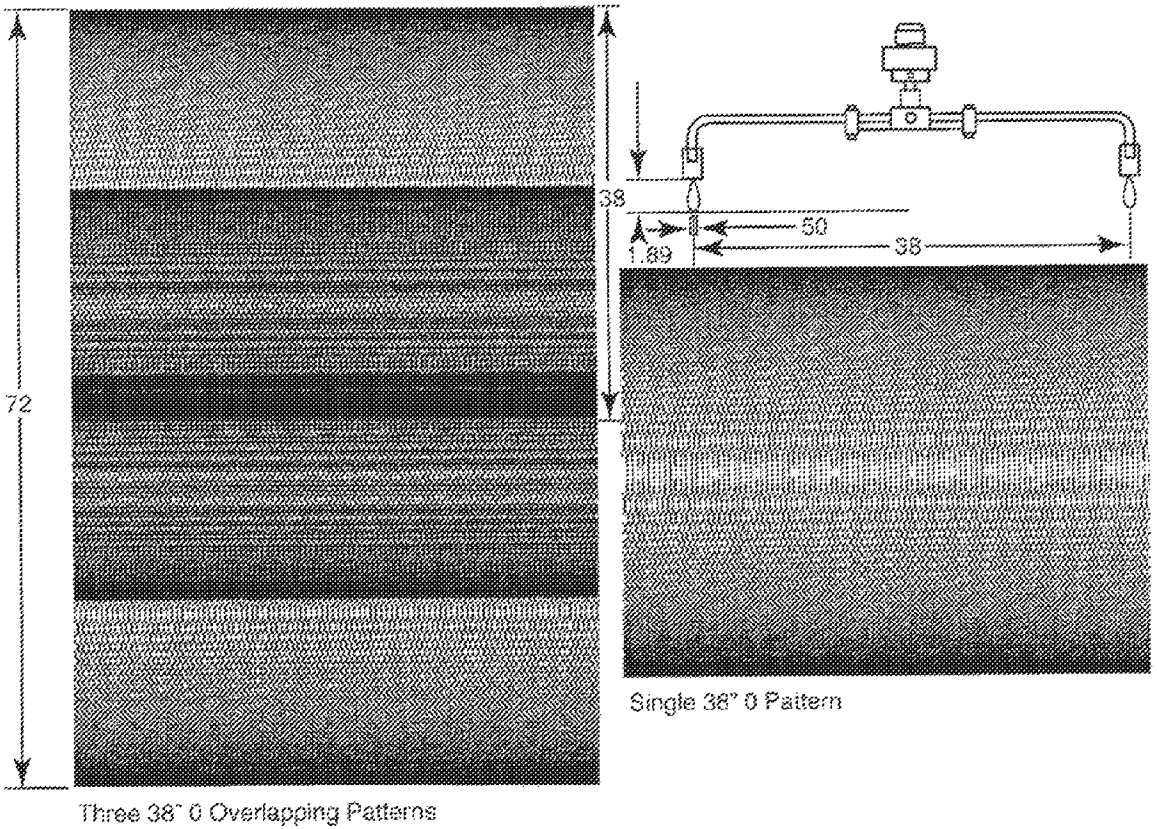
FIG. 8 illustrates a cleaning spray overlap patterns produced by the apparatus of the present invention.
Figure 9:
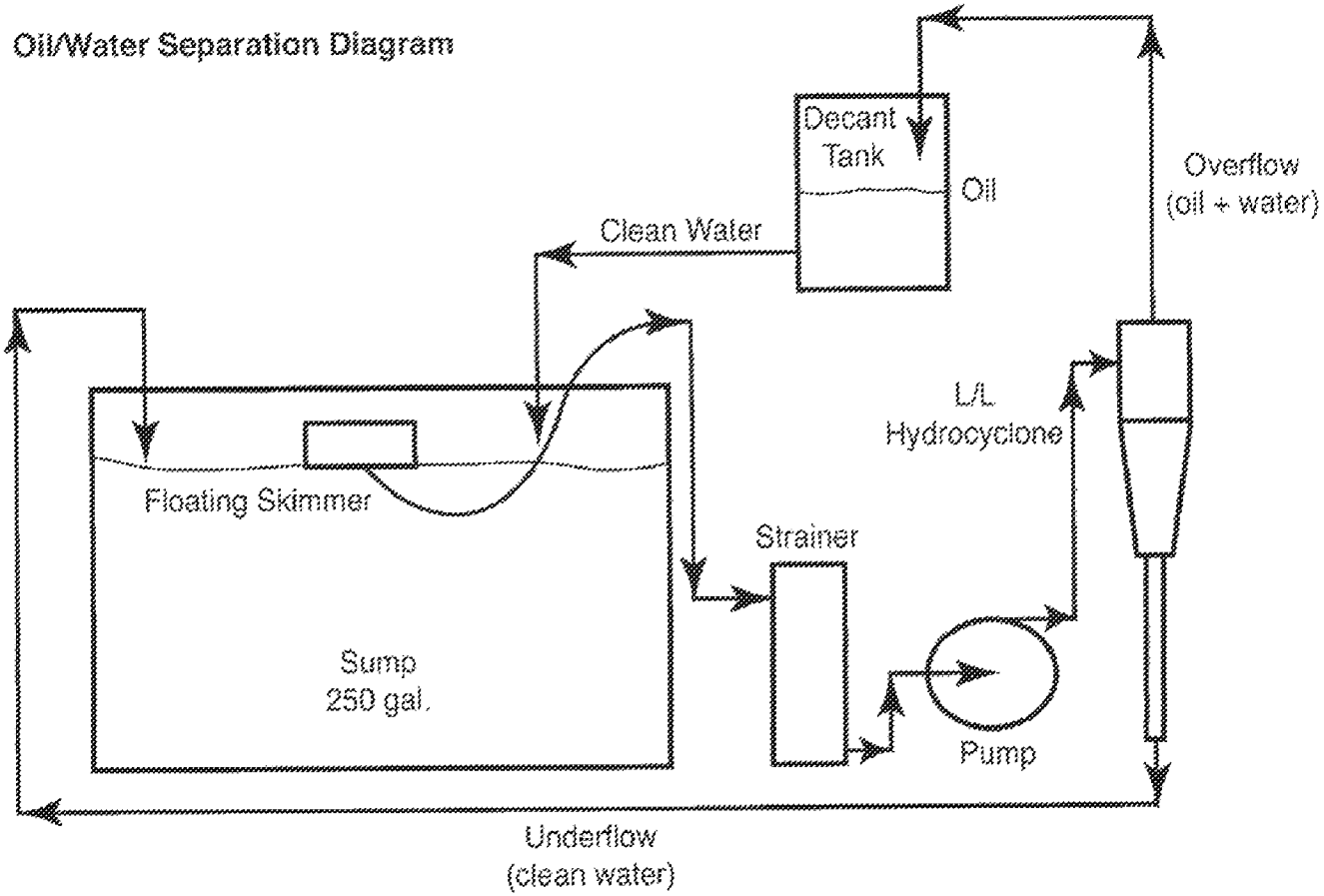
FIG. 9 is a table of oil-water separation test results of the present invention.
Figure 10:
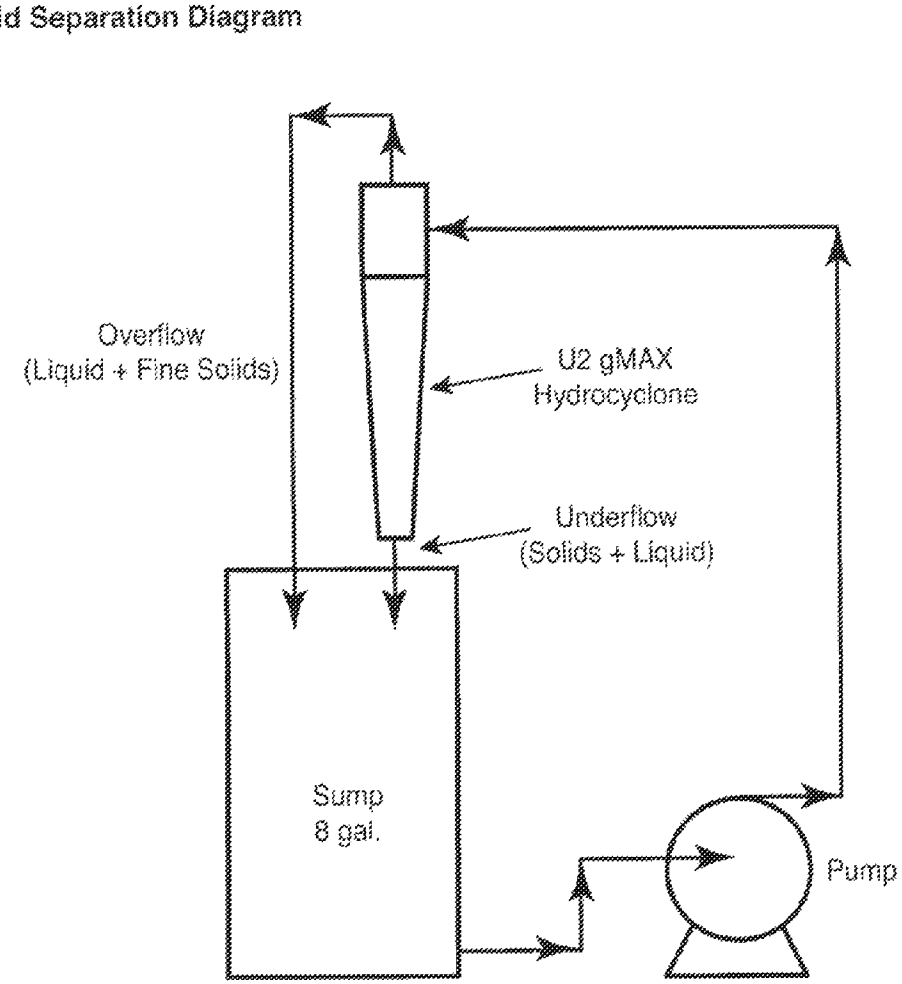
FIG. 10 illustrates a solid-liquid separation diagram of the apparatus of the present invention.
Figure 11:
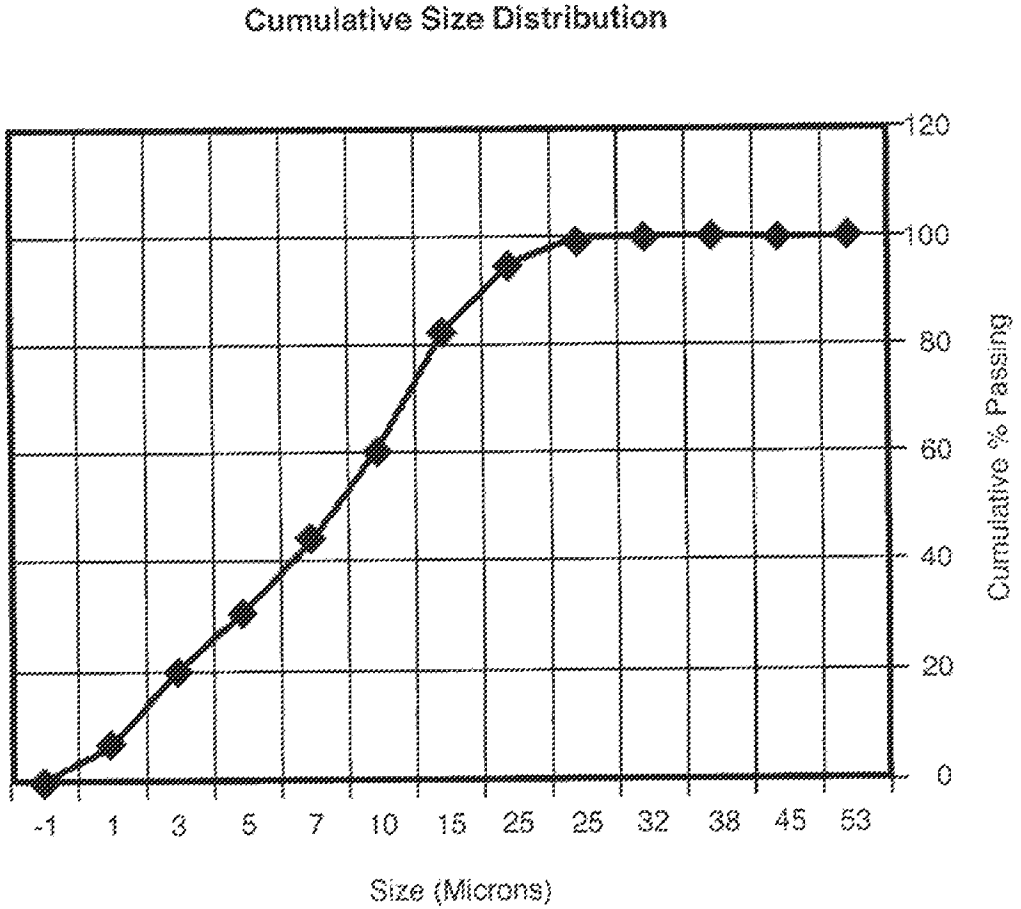
FIG. 11 illustrates the results of the solid-liquid cyclone test results.

As described more fully in the Examples below, FIG. 8 illustrates the coverage patterns generated by the present invention; FIG. 9 illustrates a schematic diagram of an oil/water separation scheme of the present invention; FIG. 10 illustrates a diagram of the testing apparatus; and FIG. 11 illustrates a graph of the solid-liquid cyclone evaluation results.

INDUSTRIAL APPLICABILITY

The invention is further illustrated by the following non-limiting examples.

Example 1

By way of example, the following is provided to describe in greater detail a preferred embodiment of the present invention:

Although all components are not required, an embodiment according to the present invention, was constructed with the following characteristics, included: an integrated cleaning-recovery and wash water recycle system; a 10,000 $ft^2$ per hour-25,000 $ft^2$ per hour cleaning productivity rate; a 6 foot wide integral cleaning head; four wheel steering with selectable 2 wheel steering mode; a 11.6 inch 4-wheel steering turning radius (outer wheels); a hydrostatic drive mechanism capable of variable speeds from 0.4 to 5 mph; a single 126 hp diesel engine; a remote pressure washing attachment for manual touch-up cleaning; 10-12 inches ground clearance; 60 inches overall height; and several safety features including but not limited to "Dead-Man" pedal and automatic brake with the loss of hydraulic pressure, secured fasteners, hand operated parking brake, towable after primary power failure, low chassis tie-downs, lift points, foam filled tires, weight placard, and center of gravity marked.

The constructed vehicle was powered by a diesel engine. The engine produced continuous horsepower (e.g. 126 hp) and ran a primary hydraulic pump which in turn operated vehicle mobility and steering. The engine provided direct drive rotational power to the primary water cleaning pump. The engine was accessorized with a secondary hydraulic pump that powered two circulating pump motors and the vacuum recovery blower.

The engine selected was a 140 hp at 2400 rpm intermittent, 126 hp at 2400 rpm continuous use with a, peak torque of 367 ft lbs at 1400 rpm, Tier III compliance as required by US EPA for all certified engines, emission requirements met without degradation of engine performances or power level; quick engine change capable, and a 24 volt electrical system.

The vehicle chassis was based on a fusion-welded reinforced ladder bar frame design using, e.g. ASTM A500 Grade A or B rectangular tube, plate, and some common structural shapes. An epoxy or polyester thermoset powder coat finish was applied.

The vehicle that was built included identical front and rear axle/steering suspension components, all wheel hubs preferably had the same bolt pattern so all four wheels were interchangeable, hydrostatic differential steering with conventional steering wheel control, the frame had four low chassis tie down points; four lift points, (no spreader bar was needed), compact planetary gear reduction wheel drive with integral variable speed hydraulic motor and the steering-braking systems were in an isolated circuit.

Example 2

After construction, the vehicle was tested. However, before testing of the cleaning effectiveness was attempted, a study of available nozzle types was done. The nozzle types surveyed included standard 0-80 degree 1-piece metallic nozzles to multiple component (single head) designs that incorporate a spinning mechanism. Several proprietary designs were examined that did purport performance beyond typical single piece nozzles. The cost and reliability issues of these rotating nozzle types were weighed against their adoption.

The deck width of six feet and a goal of 10,000 $ft^2$ per hour cleaning rate dictated a forward travel speed of approximately 0.4 miles per hour. This speed range was used to qualify the cleaning requirements and rotating nozzle design. An approximate 2 inch stand off distance was found to avoid contact between the rotating nozzle head and any deck level obstructions which were likely to be encountered on a deck of an aircraft carrier. When practically possible, the standoff distance was reduced due to impingement effectiveness being higher with less distance. However, 2 inches achieved acceptable performance. Measurements taken illustrated a maximum clearance of 1.75 inch and a ¼ inch margin of safety was added for a total of 2 inches.

A positive displacement pump was selected due to maintenance advantages compared with other types of pumps. The factors considered were: maintenance issues such as packing type and seal composition, water quality requirements, location of manufacture in regards to spare parts availability, and the actual size of the pump versus the pressure and flow rate capabilities.

The largest challenge in selecting a pump was in the form factor of the actual pump. The pressure and flow range generally dictated that the pumps were outside the "water blasting" market. Numerous manufacturers offer triplex positive displacement pumps in the parameter range selected. Pumps were selected based on strong maintenance advantages and seal composition compared with other pumps. A stainless steel "liquid-end" and low-seal-wear ceramic plungers were also a factor. Seals with solid EPM were selected to provide desirable results. Valves in the unit were expected to operate for 3000 hrs. Basic energy calculations were made based on 5000 psi and 15 gpm in order to determine the effects of water recycling. The calculations yielded 55° F. temperature rise in one hour. This level did not require a heat exchanger in order to protect pumping or delivery equipment.

A 2 inch high spray bar (nozzle tip-surface) and 40 degree nozzle tips required 50 nozzles to be used in order to cover a six foot wide spray path.

During testing, a single spray nozzle at equivalent standoff distances fared poorly compared with a rotating head surface cleaner. The rotating spray bar, by use of standard nozzle tips and a singular rotating swivel, is used in a majority of industrial cleaning applications. Only rotating spray bar designs were used. Testing was conducted using lower pressures and a rotating head surface cleaner.

A thorough study of hydrocyclone effectiveness in various configurations was performed. In one embodiment, a single U2-gMAX 3020 S-L urethane cyclone was found to produce particularly desirable results and was specified to meet throughput requirements which were set at approximately 15 gpm. Desirable results were also produced by using two smaller L40-gMAX L-L cyclones in parallel. A single pump fed both cyclones and inlet and outlet connections were shared.

The cleaning effectiveness of the present invention was tested on a surface with a non-skid coating. A pressure range of 3000 psi-10,000 psi was tested on a soiled plate of nonskid. 0-15 degree nozzle tips were used with varied flow rates within the nozzle type. A stand alone 15 degree fan spray nozzle tip running at 4000 psi using 2.5 GPM was tested with success. This was followed by testing a rotating spray bar assembly using the standalone resulting parameters. The rotating spray bar performed well at the higher 0.79 mph travel speed. Testing revealed that a shorter standoff distance improved cleaning performance. Dual travel speed settings were tested to simulate a "restoration" cleaning and maintaining cleaning parameter set. It was found that 0 degree tips provided the best impingement but the least in coverage efficiency. Fifteen degree tips provided a practical best between impingement and coverage.

Vehicle travel speed, stand-off distance and water pressure/flow rate were significant variables during testing. The water pressure and flow rate determined the rotation speed in revolutions per minute (RPM) of the cleaning swivel arms. The resultant RPM produced acceptable cleaning results by angling the nozzles to rotate the swivel assembly. The non-powered RPM can be adjusted slightly by varying the relative angle of the nozzles. While adequate cleaning was accomplished with self-rotating swivels, both powered-rotation and self-rotating swivels are useful in accordance with the present invention. The swivel assemblies specified were capable of operating with both powered and self-powered modes. A powered assembly allowed greater nozzle impingement by angling nozzles perpendicular to the deck surface. A Hall-Effect rotation sensor was used to determine spinner RPM. The spinning information is used to prevent spinner over speed conditions and to detect possible nozzle clogging which can result in lower or no RPM. The on-board computer alerts the operator if the spinners are over sped or if there is a possible clogged nozzle.

By using a six foot cleaning path, several possible combinations of rotor placement exist. A two rotor design and a three rotor design were useful due to a flow rate capacity of 15 GPM. The figures below illustrate striation placement "striping" of the cleaning path at travel speeds that corresponded to 10,000 $ft^2$/Hr and 25,000 $ft^2$/Hr cleaning rates. FIG. 8 illustrates the coverage patterns generated by the present invention in accordance with the following parameters: a stand off distance of 2 inches; a 15 degree nozzle type; a 0.72 mph forward travel speed; (3) 38" diameter free spinning spray bar arm assemblies; and a 25,000 $ft^2$/hr cleaning rate.

The test concluded that there were no spaces larger than two inches as gaps. The corresponding fan spray width at 1.9 inches was two inches in width.

In another test, a non-skid surface was soiled. The surface was cleaned at various travel speeds and pressures. Only pressures up to 3500 psi were tested. A rotating head surface cleaning device was used for testing. A single fan tip was compared with the rotating spray arm method of cleaning. The non-skid was sent to a supplier for cleaning testing. The supplier used an ultra high pressure positive displacement pump in conjunction with a pressure regulating mechanism to produce various pressures for surface cleaning. A zero degree rotating spray bar nozzle tip assembly combined with vacuum recovery was evaluated.

In yet another test, pressure range of 4000-10,000 psi was evaluated. A positive displacement pressure pump combined with the water swivel for rotating spray bars was found to be effective. The tested cyclone unit was rated at 15 GPM flow rate.

In order to establish realistic testing conditions, results were obtained that show solid and oil concentrations from a sample aircraft carrier cleaning. Tests were performed and a test plan was formulated that called for a Liquid-Liquid (de-oiler) cyclone and a Solid-Liquid cyclone separately. The following conditions were used to develop a test plan that was executed. Test plan assumptions included but were not limited to: influent composition of (i) sample solid content of 7130 mg/l (median); (ii) sample oil/grease content of 1173 mg/l (median); and 1:1 ppm.

FIG. 9 illustrates a schematic diagram of an oil/water separation test which was conducted.

In the example, oil composition was an equal mixture containing diesel fuel, hydraulic oil and way oil. Table 1 below shows a relationship between "slugs" (oil concentration that was added to main tank) and samples taken from the "underflow" (L-L cyclone processed water port). The concentrations, as shown below, were calculated: 200 ml oil concentrate plus 300 ml water plus 1000 ml water recovered. The sample was taken 1 to 2 seconds after the mixture was added directly into the skimmer (at ~60 l/m flow rate). One liter of additional water was added into the mixture: 200 ml oil plus 1300 ml water which resulted in a 133,000 ppm oil concentration.

TABLE 1

L-L Cyclone Experiment Results

| Time (min.) | Slug Size (ml) | Calculated concentration. (ppm) (see Test Discussion and Notes) | Under Flow Sample #ID | Lab Results Mg/l oil conc. |
|---|---|---|---|---|
| 0 | 500 | 587 | Observe only | X |
| 15 | 500 | 587 | Observe only | Surface is clear before second slug is added |
| 20 | 0 | 440 | 1 | 48 mg/l |
| 30 | 200 diluted with 300 water. | 133,000 | 2 | 44 mg/l |
| 40 | 0 | Residual only. | 3 | 87 mg/l |
| 47 | 500 | | X | X |
| 50 | 500 | | X | X |
| 60 | 0 | 270 (based on 230 ml oil remaining) | 4 | 93 mg/l |

Total tank contents = 225 gal.
Time to recycle at 15 GPM: 15 minutes.

Samples were added to the sump with minor agitation. The samples were not fully diluted with the sump water. As a result, the intake concentration (at skimmer) was much higher than the calculated concentration that accounted for the entire fluid volume.

Sample 2 was unique due to the oil concentrate being added directly into the skimmer. The sample was taken immediately after the slug was added. The lab results returned the lowest measurement of the lot. This can be explained by virtue of the sample concentrate containing less segregated oil droplets. The relationship between oil droplet size and recovery rate is illustrated in the L-L cyclone settings.

Test results ranged from 44-93 mg/l. The similar values of the ranges tended to indicate that soluble constituents were present in the overflow. The removal of the free product (mixture FIG. 10 illustrates a diagram of the testing apparatus. All samples were taken simultaneously as the solid samples were added. Test duration was a period of 35 minutes where various slugs were added to the sump and samples were taken.

The samples were retrieved by placing a sample container below the cyclone underflow immediately after the slug had been added to the sump.

The composition of the test sample solids (as determined by slug composition) were slug 1: low specific gravity coarse sample comprising IX Resin with a specific gravity of 1.2-1.4; slug 2: fine particulate comprising paint chips, sand and ground dirt, and used sand blast media combined with larger particles as found in sample 1; and slug 3: very fine particulate comprising IX resin S.G. 1.2-1.4<10 μm.

FIG. 11 illustrates a graph of the solid-liquid cyclone evaluation results obtained.

The preceding examples can be repeated with similar success by substituting the generically or specifically described operating conditions of this invention for those used in the preceding examples.

Although the invention has been described in detail with particular reference to these preferred embodiments, other embodiments can achieve the same results. Variations and modifications of the present invention be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A mobile cleaning apparatus comprising:
one or more wheels;
a vacuum recovery system;
a water processing system; and
a cleaning deck, said cleaning deck comprising
a front deck portion, said front deck portion comprising a nozzle disposed on an underside of said front deck portion;
a rear deck portion, said rear deck portion comprising a vacuum inlet disposed on an underside of said rear deck portion; and
at least one flow-equalizer port disposed between said front deck and said rear deck portion on a side end portion of said rear deck portion.

2. The apparatus of claim 1 wherein said cleaning deck further comprises a separating membrane disposed between said front deck portion and said rear deck portion.

3. The apparatus of claim 1 further comprising a brush skirt, said brush skirt comprising a plurality of brushes.

4. The apparatus of claim 1 wherein said cleaning deck further comprises at least one swivel.

5. The apparatus of claim 1 further comprising a brush skirt at least partially surrounding the circumference of said cleaning deck.

6. The apparatus of claim 5 wherein said brush skirt further comprises a membrane insert.

7. The apparatus of claim 1 wherein said cleaning deck further comprises a plurality of flow equalizer ports disposed between said front deck portion and said rear deck portion.

8. A cleaning deck comprising:
a front deck portion, said front deck portion comprising a nozzle disposed on an underside of said front deck portion;
a rear deck portion, said rear deck portion comprising a vacuum inlet disposed on an underside of said rear deck portion; and
at least one flow-equalizer port disposed between said front deck and said rear deck portion on a side end portion of said rear deck portion.

9. The cleaning deck of claim 8 comprising one or more inlet holes disposed in said front deck portion.

10. The cleaning deck of claim 9 wherein said one or more inlet holes are disposed through a top of said front deck portion.

11. The cleaning deck of claim 8 wherein at least a portion of said cleaning deck comprises skirting.

12. The cleaning deck of claim 8 further comprising skirting, said skirting comprising a brush material.

13. The cleaning deck of claim 12 wherein said skirting further comprises a membrane.

14. The cleaning deck of claim 13 wherein said membrane comprises one or more membrane inserts.

15. The cleaning deck of claim 13 wherein said membrane is disposed in said brush material.

16. The cleaning deck of claim 8 wherein air is directed through said flow-equalizer ports.

17. The cleaning deck of claim 8 wherein two flow-equalizer ports are disposed between said front deck portion and said rear-deck portion.

18. The cleaning deck claim 8 further comprising skirting, said skirting at least partially separating said front deck portion from said rear deck portion.

19. The cleaning deck of claim 8 further comprising skirting, said skirting comprising a membrane.

20. A cleaning deck comprising:
a front deck portion comprising a rotary nozzle assembly, said front deck portion surrounded at least partially by skirting;
a rear deck portion comprising a vacuum inlet, said rear deck portion surrounded at least partially by skirting; and
at least one flow-equalizer port disposed between said front deck and said rear deck portion on a side end portion of said rear portion.

21. The cleaning deck of claim 20 wherein said skirting comprises a brush material.

22. The cleaning deck of claim 21 wherein said skirting further comprises a membrane.

23. The cleaning deck claim 22 wherein said membrane comprises one or more membrane inserts.

24. The cleaning deck of claim 21 wherein a membrane is disposed in a brush material.

25. The cleaning deck of claim 20 wherein air is directed through said flow-equalizer ports.

26. The cleaning deck of claim 20 wherein two flow-equalizer ports are disposed between said front deck portion and said rear-deck portion.

* * * * *